US005577807A

United States Patent [19]

Hodge et al.

[11] Patent Number: 5,577,807

[45] Date of Patent: Nov. 26, 1996

[54] ADJUSTABLE CHAIR ACTUATOR

[75] Inventors: David N. Hodge, The Sea Ranch, Calif.; David C. Jenkins, Grand Rapids, Mich.; Michael L. Mercier, Grandville, Mich.; David S. Teppo, East Grand Rapids, Mich.; Larry G. Lindgren, Rockford, Mich.; Jeffery L. Halliwill, Gowen, Mich.; James M. Mancewicz, Wyoming, Mich.

[73] Assignee: Steelcase Inc., Grand Rapids, Mich.

[21] Appl. No.: 257,648

[22] Filed: Jun. 9, 1994

[51] Int. Cl.[6] ..... A47C 1/024

[52] U.S. Cl. ..... 297/463.1; 297/301.7; 297/300.8; 297/303.3

[58] Field of Search ..... 297/300.3, 300.8, 297/301.7, 302.2, 302.7, 303.3, 303.1, 303.2, 303.4, 463.1, 463.2, 344.19

[56] References Cited

U.S. PATENT DOCUMENTS

| | | |
|---|---|---|
| 84,755 | 12/1868 | Perry et al. . |
| T103,201 | 7/1983 | Robinson . |
| 216,203 | 6/1879 | Marx . |
| D. 285,629 | 9/1986 | Franck et al. . |
| 362,796 | 5/1887 | Tait . |
| 609,389 | 8/1898 | Garland . |
| 1,302,212 | 4/1919 | Phillips . |
| 1,348,121 | 7/1920 | Kuderer . |
| 1,699,894 | 1/1929 | Klemm . |
| 2,145,307 | 1/1939 | Hunt . |
| 2,221,268 | 11/1940 | Sears . |
| 2,272,980 | 2/1942 | McLellan et al. . |
| 2,278,080 | 3/1942 | Koenigkramer et al. . |
| 2,310,366 | 2/1943 | Harman . |
| 2,310,476 | 2/1943 | Todd . |
| 2,321,385 | 6/1943 | Herold . |
| 2,471,024 | 5/1949 | Cramer . |
| 2,479,175 | 8/1949 | McArthur . |
| 2,538,507 | 1/1951 | Cramer . |

(List continued on next page.)

FOREIGN PATENT DOCUMENTS

| | | |
|---|---|---|
| 708283 | 12/1930 | France . |
| 691437 | 5/1940 | Germany . |
| 3322450 | 6/1983 | Germany . |
| 640801 | 6/1962 | Italy . |
| 164790 | 9/1958 | Switzerland . |
| 15751 | 11/1914 | United Kingdom . |
| 222898 | 10/1924 | United Kingdom . |
| 385157 | 12/1932 | United Kingdom . |
| 770169 | 3/1957 | United Kingdom . |
| 794138 | 4/1958 | United Kingdom . |
| 1278501 | 6/1972 | United Kingdom . |

OTHER PUBLICATIONS

Exhibit A is a product brochure entitled "Wilkhahn FS+ Manager", Published by Wilkhahn GmbH, copyright 1981.
Exhibit B is a product brochure entitled "Wilkhahn FS+ Seating", Published by Wilkhahn GmbH, copyright 1981.
Exhibit C is a product tag entitled "VECTA", Published by Veca, copyright 1991.

*Primary Examiner*—Peter R. Brown
*Attorney, Agent, or Firm*—Price, Heneveld, Cooper, DeWitt & Litton

[57] ABSTRACT

An adjustable chair includes a base, a back support, a control on the base, a seat positioned on the control and an actuator housing supported on the base. The control mounts the back for tilting movement between a fully upright position and reclined position. A seat is pivoted to the base at a front end. The seat is also connected to the base by a plurality of locking plates. The chair includes a back stop subassembly, a back or seat tension subassembly, a seat tilt subassembly and a seat depth subassembly. The actuator housing is an elongated, tubular member having concentrically mounted controls or actuators at each end. At one end of the actuator, a rotatable actuator controls back tilt tension and a concentrically mounted, push button actuator controls the back tilt or stop position. At the opposite end of the actuator housing, a rotatable actuator controls seat tilt position and a concentrically mounted pivotal lever or button controls positioning of the seat to adjust the depth through the depth subassembly.

31 Claims, 17 Drawing Sheets

U.S. PATENT DOCUMENTS

| | | | |
|---|---|---|---|
| 2,627,898 | 2/1953 | McStay et al. . | |
| 2,662,582 | 12/1953 | Lorenz . | |
| 2,686,558 | 8/1954 | Fox . | |
| 2,827,951 | 3/1958 | Herider et al. . | |
| 2,868,967 | 1/1959 | Poppa et al. . | |
| 2,894,566 | 7/1959 | Herider et al. . | |
| 2,912,045 | 11/1959 | Milly . | |
| 2,924,265 | 2/1960 | Himka . | |
| 2,956,619 | 10/1960 | Scherer . | |
| 2,961,035 | 11/1960 | Lorenz . | |
| 3,046,055 | 7/1962 | Martens . | |
| 3,062,584 | 11/1962 | Galla . | |
| 3,111,343 | 11/1963 | Pearson . | |
| 3,127,788 | 4/1964 | Martens . | |
| 3,201,079 | 8/1965 | Doetsch . | |
| 3,286,971 | 11/1966 | Walter et al. . | |
| 3,295,885 | 1/1967 | Barksdale . | |
| 3,339,975 | 9/1967 | Posh . | |
| 3,350,135 | 10/1967 | Martens . | |
| 3,356,411 | 12/1967 | Homier et al. . | |
| 3,369,841 | 2/1968 | Heyl, Jr. . | |
| 3,402,964 | 9/1968 | Williams . | |
| 3,515,433 | 6/1970 | Tabor . | |
| 3,517,965 | 6/1970 | Cowles et al. . | |
| 3,536,358 | 10/1970 | Masucci . | |
| 3,674,308 | 7/1972 | Radding . | |
| 3,709,535 | 1/1973 | Rothermel | 297/302.7 X |
| 3,727,974 | 4/1973 | Swenson et al. . | |
| 3,758,157 | 9/1973 | Fries . | |
| 3,788,587 | 1/1974 | Stemmler . | |
| 3,801,155 | 4/1974 | Hodgen et al. . | |
| 3,877,088 | 4/1975 | Bouman . | |
| 3,881,772 | 5/1975 | Mohrman . | |
| 3,897,608 | 8/1975 | Impicciche . | |
| 3,916,461 | 11/1975 | Kerstholt . | |
| 3,921,952 | 11/1975 | Wirges . | |
| 3,947,766 | 3/1976 | Kawasaki . | |
| 3,975,050 | 8/1976 | McKee . | |
| 3,989,297 | 11/1976 | Kerstholt . | |
| 4,045,739 | 8/1977 | Kawasaki . | |
| 4,054,318 | 10/1977 | Costin . | |
| 4,062,587 | 12/1977 | Wolters . | |
| 4,070,058 | 1/1978 | Muehling . | |
| 4,101,167 | 7/1978 | Örnberg . | |
| 4,154,477 | 5/1979 | Swenson et al. . | |
| 4,198,094 | 4/1980 | Bjerknes et al. . | |
| 4,208,071 | 6/1980 | Pesiri . | |
| 4,312,728 | 1/1982 | Kamachi et al. . | |
| 4,314,728 | 2/1982 | Faiks . | |
| 4,328,943 | 5/1982 | Eldon, III . | |
| 4,354,710 | 10/1982 | Rauschenberger . | |
| 4,372,611 | 2/1983 | Feddeler . | |
| 4,373,692 | 2/1983 | Knoblauch et al. . | |
| 4,375,301 | 3/1983 | Pergler et al. . | |
| 4,384,743 | 5/1983 | Barley . | |
| 4,390,206 | 6/1983 | Faiks et al. . | |
| 4,401,343 | 8/1983 | Schmidt . | |
| 4,408,800 | 10/1983 | Knapp . | |
| 4,418,583 | 12/1983 | Taig . | |
| 4,432,582 | 2/1984 | Wiesmann et al. . | |
| 4,432,583 | 2/1984 | Russo et al. . | |
| 4,438,898 | 3/1984 | Knoblauch et al. . | |
| 4,451,085 | 5/1984 | Franck et al. . | |
| 4,478,454 | 10/1984 | Faiks . | |
| 4,479,679 | 10/1984 | Fries et al. . | |
| 4,494,795 | 1/1985 | Rossien et al. . | |
| 4,498,702 | 2/1985 | Raftery . | |
| 4,504,090 | 3/1985 | Goldman . | |
| 4,509,793 | 4/1985 | Wiesmann et al. . | |
| 4,529,247 | 7/1985 | Stumpf et al. . | |
| 4,537,445 | 8/1985 | Neuhoff . | |
| 4,589,697 | 5/1986 | Bauer et al. . | |
| 4,595,237 | 6/1986 | Nelsen . | |
| 4,627,662 | 12/1986 | Carter et al. . | |
| 4,636,004 | 1/1987 | Neumüller . | |
| 4,640,547 | 2/1987 | Fromme . | |
| 4,648,654 | 3/1987 | Voss . | |
| 4,652,050 | 3/1987 | Stevens . | |
| 4,653,806 | 3/1987 | Willi . | |
| 4,660,886 | 4/1987 | Terada et al. . | |
| 4,687,251 | 8/1987 | Kazaoka et al. . | |
| 4,693,514 | 9/1987 | Völkle . | |
| 4,695,093 | 9/1987 | Suhr et al. . | |
| 4,709,963 | 12/1987 | Uecker et al. . | |
| 4,720,142 | 1/1988 | Holdredge et al. . | |
| 4,743,065 | 5/1988 | Meiller et al. . | |
| 4,744,600 | 5/1988 | Inoue . | |
| 4,776,633 | 10/1988 | Knoblock et al. . | |
| 4,790,600 | 12/1988 | Behringer . | |
| 4,795,212 | 1/1989 | Bailey et al. . | |
| 4,796,951 | 1/1989 | Tamura et al. . | |
| 4,824,173 | 4/1989 | Tomita . | |
| 4,830,431 | 5/1989 | Inoue . | |
| 4,832,402 | 5/1989 | Zünd . | |
| 4,840,426 | 6/1989 | Vogtherr et al. . | |
| 4,858,993 | 8/1989 | Steinmann . | |
| 4,889,384 | 12/1989 | Sulzer . | |
| 4,911,501 | 3/1990 | Decker et al. . | |
| 4,944,554 | 7/1990 | Gross et al. . | |
| 4,958,536 | 9/1990 | Baumgarten . | |
| 4,981,326 | 1/1991 | Heidmann . | |
| 4,984,846 | 1/1991 | Ekornes . | |
| 4,986,601 | 1/1991 | Inoue . | |
| 4,988,145 | 1/1991 | Engel . | |
| 5,007,678 | 4/1991 | DeKraker . | |
| 5,035,466 | 7/1991 | Mathews et al. . | |
| 5,046,780 | 9/1991 | Decker et al. . | |
| 5,056,866 | 10/1991 | Tobler . | |
| 5,066,069 | 11/1991 | DeGelder . | |
| 5,069,496 | 12/1991 | Kunh et al. . | |
| 5,106,157 | 4/1992 | Nagelkirk et al. . | |
| 5,107,720 | 4/1992 | Hatfield . | |
| 5,192,114 | 3/1993 | Hollington et al. . | |
| 5,222,783 | 6/1993 | Lai | 297/303.4 X |
| 5,244,253 | 9/1993 | Hollington et al. . | |
| 5,282,670 | 2/1994 | Karsten et al. . | |
| 5,333,368 | 8/1994 | Kriener et al. . | |
| 5,348,371 | 9/1994 | Miotto | 297/303.2 |

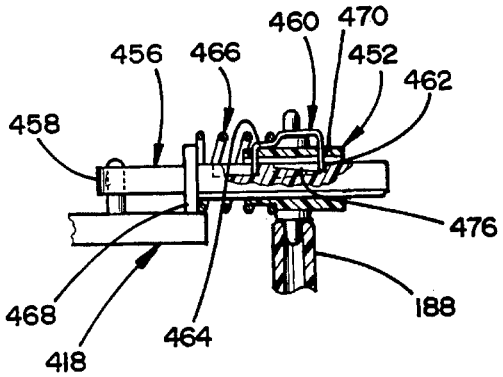
Fig. 32
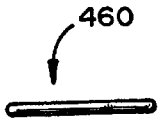
Fig. 36
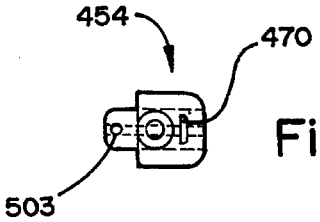
Fig. 33
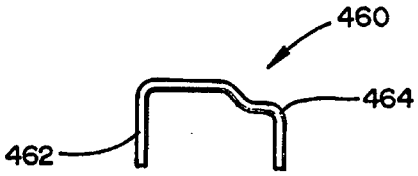
Fig. 37
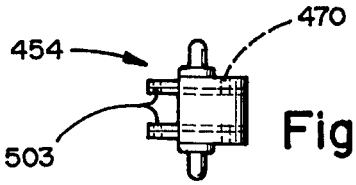
Fig. 34
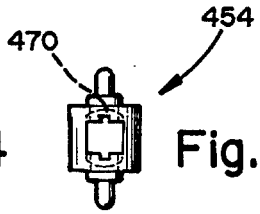
Fig. 35
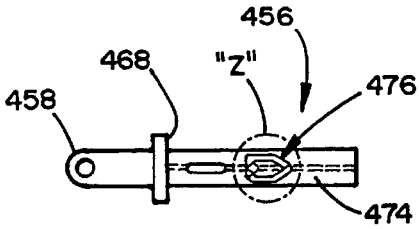
Fig. 38
Fig. 41
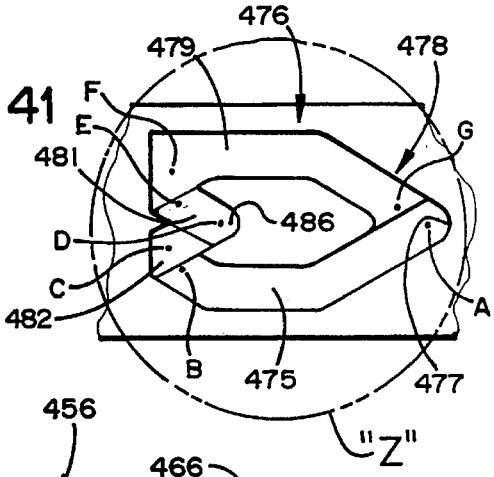
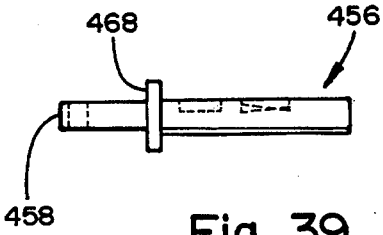
Fig. 39
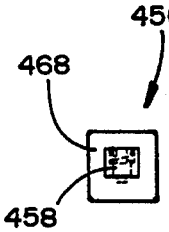
Fig. 40
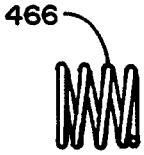
Fig. 42

ADJUSTABLE CHAIR ACTUATOR

BACKGROUND OF THE INVENTION

The present invention relates to office furniture and, more particularly, to adjustable chairs.

A wide variety of office chairs are available which include adjustable features to adapt them to the particular user and the task involved. Users of the chairs may, of course, vary significantly in physical characteristics. In addition, the user may wish to position himself differently depending upon the task being performed. Fully adjustable office chairs typically include a base or pedestal subassembly which supports a chair control. A seat is mounted on the chair control, and a back is pivoted to the chair control. The control allows tilting of the chair back with respect to the seat and the base. Provision is typically made for adjusting the preload or tension on the back support structure to adapt the chair to the particular user. Vertical height adjustment of the seat may be provided through a height adjustment mechanism in the base structure. Provision may be made for adjusting the angular position of the seat relative to the base and/or relative to the back. Provision may further be made to adjust the seat depth, that is, the position of the seat in a front-to-rear direction relative to the base and the back structure. Further, such chairs may include vertically adjustable armrest subassemblies. Examples of prior task oriented, adjustable chairs including some of these features may be found in U.S. Pat. No. 5,282,670 entitled CABLE ACTUATED VARIABLE STOP MECHANISM, which issued on Feb. 1, 1994, to Karsten et al.; U.S. Pat. No. 5,007,678 entitled CHAIR BACK HEIGHT ADJUSTMENT MECHANISM, which issued on Apr. 16, 1991, to DeKraker; U.S. Pat. No. 4,720,142 entitled VARIABLE BACK STOP, which issued on Jun. 9, 1988, to Holdredge; and U.S. Pat. No. 4,494,795 entitled VARIABLE BACK ADJUSTER FOR CHAIRS, which issued on Jan. 22, 1985, to Rozen.

As the adjustability features provided for chairs have increased, a corresponding increase in the number of actuators, controls, buttons and levers has resulted. Problems have been experienced with the positioning of the actuators and their controls. The controls must be integrated into the chair. The positioning and operation is generally not logical or readily apparent. In fact, many users are completely unaware of the existence of certain adjustable features. Certain features, such as back tension adjustment, are not usable while the user is seated due to their position under the chair. A need exists for an improved adjustable chair which provides a full range of adjustable features and which includes an actuator structure conveniently positioning and locating one or all of a plurality of various controls and actuators.

SUMMARY OF THE INVENTION

In accordance With the present invention, the aforementioned need is fulfilled. Essentially, an adjustable chair is provided which includes a base, a back support, a control pivotally connecting the back support to the base and a seat. A central actuator housing is supported on the base. The housing mounts the actuators or control mechanisms for the adjustable subassemblies incorporated in a chair in a convenient location and in a logical order for ready use by the chair occupant.

In narrower aspects of the invention, the housing is an elongated, tubular member having ends positioned generally adjacent the lateral edges of the seat. A first actuator is rotatably mounted on an end of the .actuator housing. A second actuator is positioned concentrically with the first actuator within the end of the housing. In one form, the second actuator is a push button. In another form, the actuator is a pivotally mounted button or lever.

In further aspects of the present invention, the chair includes a torsional energy supply device which resiliently biases the back and back support members to an upright position. In one form, the first actuator at one end of the actuator housing is operably connected to the torsional energy storage device, permitting adjustment of the preload and, hence, the amount of force required to tilt the back from the fully upright position toward a reclined position.

In further aspects of the invention, the chair may be provided with a stop mechanism or subassembly which limits tilting motion of the chair back with respect to the base or the seat. The stop mechanism may provide a variable stop which results in a variety of maximum tilt positions. In the alternative, the mechanism may lock the seat back in an upright position and prevent all tilting action. The second actuator at the end of the actuator housing is operably connected to the stop subassembly. In the preferred form, the first and second actuators are concentric with each other.

In addition, the adjustable chair in accordance with the present invention may be provided with seat adjustment features including a seat tilt subassembly which adjusts the angular position of the seat with respect to the base and the back. A seat depth subassembly may also be provided which permits forward and rearward movement of the seat relative to the base, chair control and the back. In this form, an end of the actuator housing includes a rotatable actuator which is operably connected to the seat tilt adjustment subassembly. A second actuator is pivotally mounted concentrically with the rotatable actuator. The second actuator is adjustably connected to the seat depth subassembly through a cable subassembly.

The adjustable chair may be provided with one or all of the adjustment mechanisms. In the preferred form, the back control mechanisms, including the back stop and tilt tension control, are actuated by the actuators located at one end of the actuator housing. The seat adjustment features, including the tilt and depth adjustment subassemblies, are actuated by concentrically positioned actuators mounted at the other end of the actuator housing.

The chair, actuator housing and actuator subassemblies in accordance with the present invention conveniently and logically position the controls for the various adjustable features of the chair. A compact and readily integrated package arrangement results. The ornamental appearance of the chair seat and back need not be altered to integrate the package. The actuator housing is easily attached to the chair base. The chair may be provided with one or all of the various adjustment features and the actuator housing end subassemblies readily accommodate such options. Features may be added to the chair or eliminated during assembly or in the field. The chair and actuator subassemblies in accordance with the present invention are relatively economical to manufacture, efficient in use and capable of long and reliable life.

BRIEF DESCRIPTION OF THE DRAWINGS

FIG. 32 is an elevational view of a lock or catch assembly incorporated in the subassembly of FIG. 19;

FIG. 33 is a top view of a support housing;

FIG. 34 is a side view of the support housing;

FIG. 35 is an end view of the support housing;

FIG. 36 is a bottom view of a wire catch;

FIG. 37 is an elevational view of the wire catch;

FIG. 38 is a top view of a slide or plunger;

FIG. 39 is a side view of the slide;

FIG. 40 is an end view of the slide;

FIG. 41 is an enlarged view of the circled portion designated by the letter Z in FIG. 38;

FIG. 42 is an enlarged view of the catch spring;

DETAILED DESCRIPTION OF THE PREFERRED EMBODIMENT

General

Figure 1:
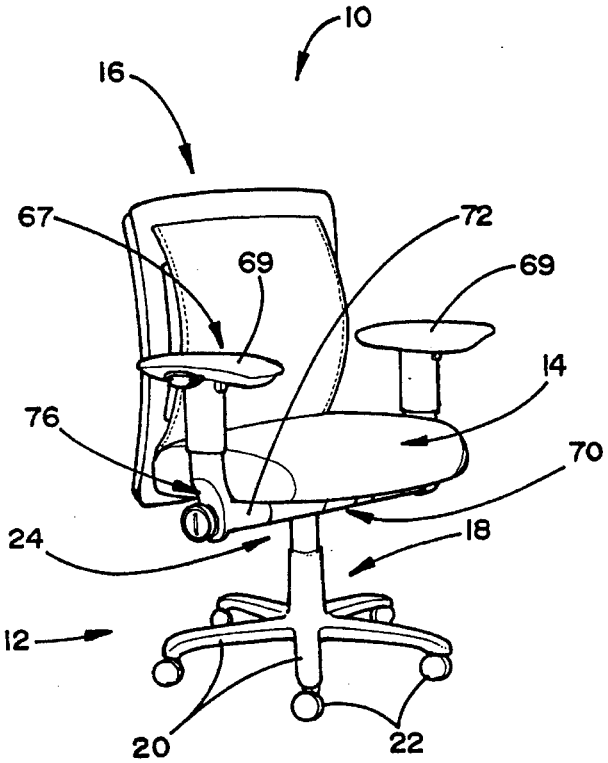
FIG. 1 is a perspective view of an adjustable chair in accordance with the present invention.

An adjustable chair in accordance with the present invention is illustrated in FIG. 1 and generally designated by the numeral 10. Chair 10 includes a base 12, a seat subassembly 14 and a back subassembly 16. Base 12 includes a pedestal subassembly 18 having a plurality of arms 20 provided with casters 22. A chair height adjustment mechanism, such as a gas spring 24, may be incorporated into pedestal 18 in a conventional fashion. The base, therefore, permits vertical height adjustment of the seat subassembly 14 with respect to the ground. Vertical height adjustment may be achieved mechanically through a screw arrangement or a gas spring may be used. Such adjustment mechanisms are conventional.

Figure 2:
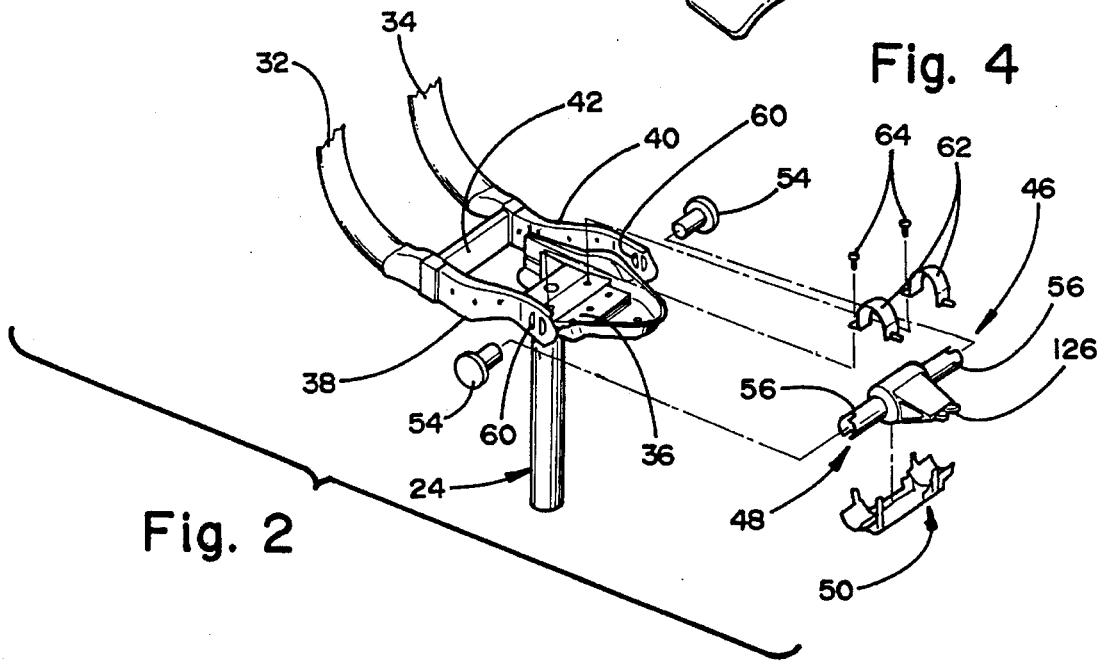
FIG. 2 is an exploded view of the chair control and back support incorporated in the present invention.

In accordance with the present, invention and as explained in detail below, chair 10 is provided with multiple adjustment features to accommodate the chair to the particular user and to the particular task involved. Seat back subassembly 16 includes back supports or uprights 32, 34 which are pivotally connected to a control housing 36 (FIG. 2). The height adjustment mechanism or a portion thereof is physically attached to an undersurface of control housing 36. Back supports 32, 34 include forward portions 38, 40. A crosspiece 42 interconnects the uprights. A torsional energy storage device or spring subassembly 46 mounts members 32, 34 at their forward ends to housing 36. Torsional energy storage device 46 includes a torsion spring and axle or bushing subassembly 48 which is received in a support bearing 50. Support bearing 50 is secured to a forward portion of the base of housing 36. Torsional bushing plugs 54 are positioned on axle portions 56 of subassembly 46. The outer ends of the axle portions 56 are received in apertures 60 defined by the forward portions of the upright members 32, 34. Retaining clamps 62 are secured by suitable fasteners 64 to clamp subassembly 46 on the housing 36. Uprights 32, 34 and, hence, the back subassembly 16 are resiliently biased to a fully upright position. The back may tilt or recline against the bias of device 46.

As explained in detail below, the chair may include a stop mechanism to limit tilting motion of the chair with respect to the base or the seat. The stop mechanism may provide a variable stop which results in a variety of maximum tilt positions. The seat subassembly 14 may be pivoted at a forward end thereof about axle portions 56 of device 46 to allow selective adjustment of the tilt angle of the seat relative to the back and the base. A seat depth control mechanism may be incorporated in the chair which allows forward and reverse adjustment of the seat toward and away from the back. Also, arm assemblies 67 may be provided with vertically and laterally adjustable armrests 69.

Overall Actuator Assembly

In accordance with the present invention, the various seat adjustment subassemblies and back adjustment subassemblies are operated by a control or actuator assembly 70 which is securable to an undersurface of housing 36. In the presently preferred form, mechanism 70 includes an elongated, tubular actuator housing 72. Housing 72 terminates in ends 74, 76. The controls or actuators for the adjustment subassemblies are mounted on and within housing 72. The controls for the seat adjustments are mounted at the left side or end 74 of tube 72 when viewed from the position of a seated user. In the presently preferred form, the controls include a first actuator or a rotatable knob 78 which is mounted concentric with or which surrounds a second actuator, actuator lever or button 80. As explained in more detail below, knob 78 controls the seat tilt subassembly. Button or lever 80 controls the seat depth subassembly.

Figure 4:
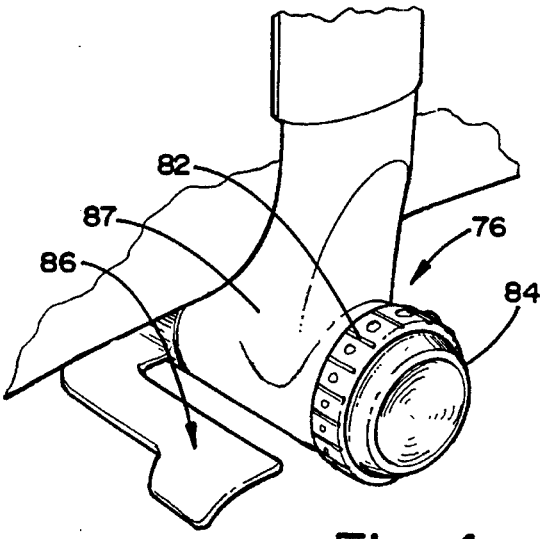
FIG. 4 is an enlarged, fragmentary, perspective view showing the left side of the actuator housing and controls in accordance with the present invention.

The back controls are located together on the right end 76 of tube 72 when viewed from the position of a seated user, as shown in FIG. 4. The controls for the back adjustment features include a first actuator or a rotatable knob 82 which adjusts the back tilt tension or preload of the energy storage device 46. Knob 82 is concentric with and surrounds a second actuator or button 84. Button 84 may be pushed by the user to control the variable back stop or back tilt subassembly. Also, as seen in FIG. 4, a chair height adjustment lever 86 may be pivoted to control housing 36 and positioned immediately adjacent the actuator tube 72.

Figure 3:
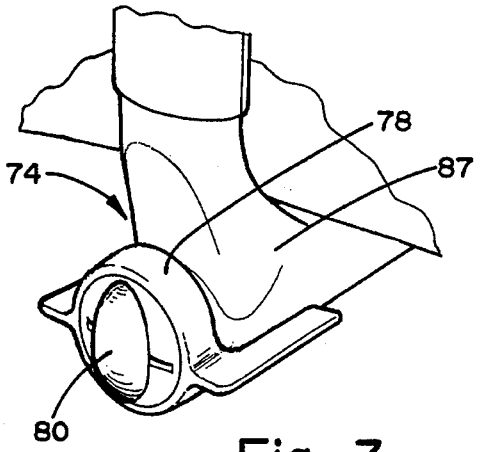
FIG. 3 is an enlarged, fragmentary, perspective view showing the right side of the actuator housing and controls in accordance with the present invention.
Figure 6:
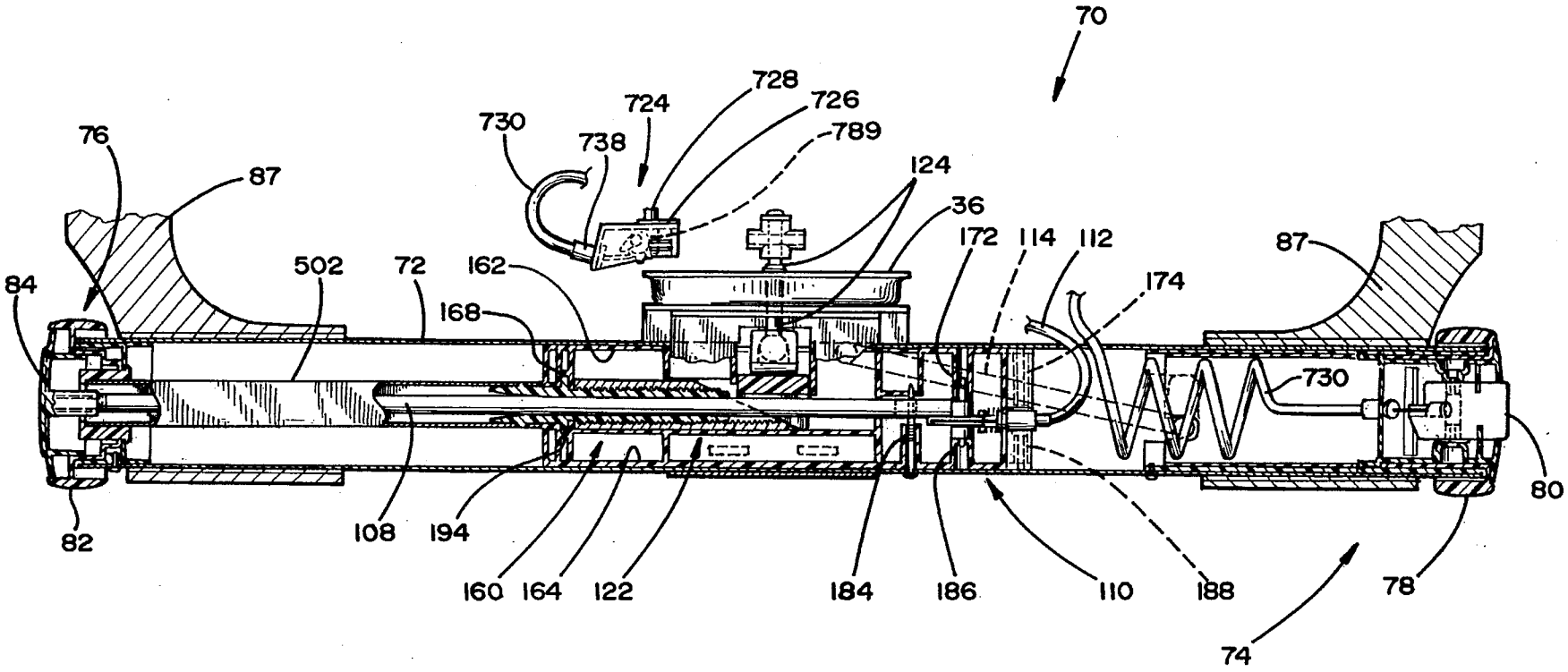
FIG. 6 is a fragmentary, front elevational view of the subassembly of FIG. 5.
Figure 7:
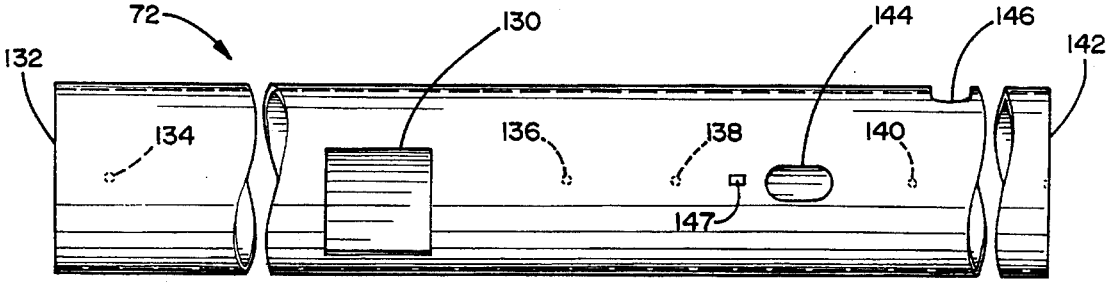
FIG. 7 is an elevational view of the actuator tube or housing incorporated in the present invention.
Figure 8:
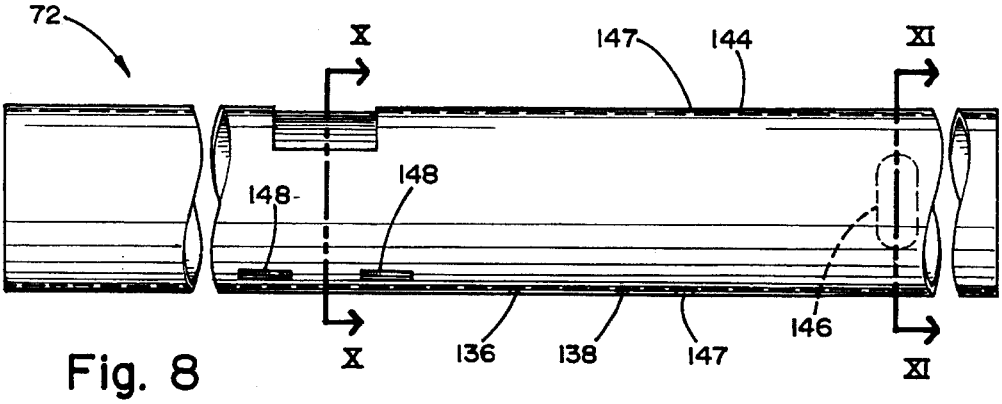
FIG. 8 is another view of the housing of FIG. 7.
Figure 9:
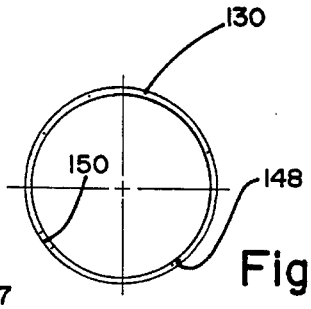
FIG. 9 is a left end view of the housing of FIG. 7.
Figure 10:
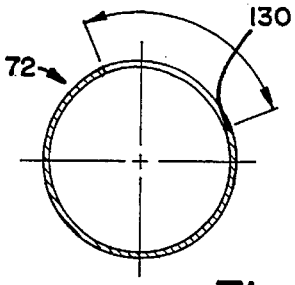
FIG. 10 is a cross-sectional view taken generally along line X—X of FIG. 8.
Figure 11:
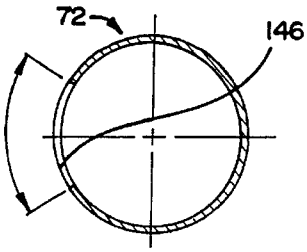
FIG. 11 is a cross-sectional view taken generally along line XI—XI of FIG. 8.
Figure 14:
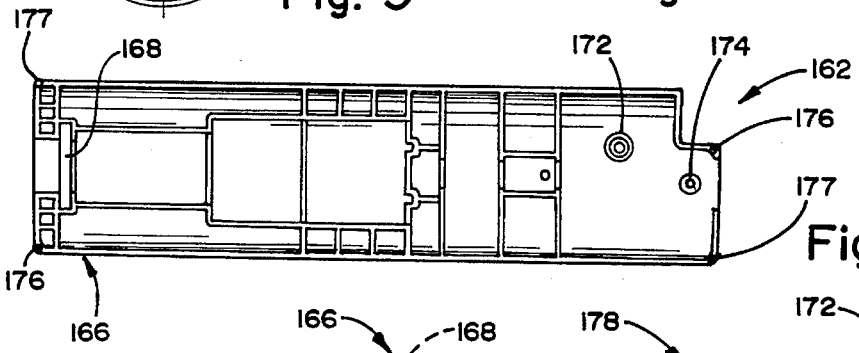
FIG. 14 is a top, plan view of the upper half of an inner support incorporated in the present invention.
Figure 15:
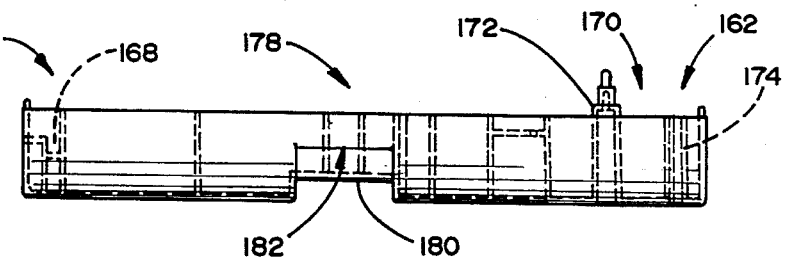
FIG. 15 is a side, elevational view of the upper half of the inner support of FIG. 14.
Figure 12:
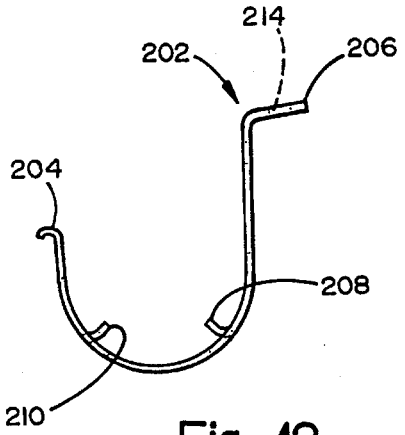
FIG. 12 is a side, elevational view of a securement strap.

Arm assemblies 67 may include a casting 87 which is supported on actuator tube 72 as seen in FIGS. 3, 4 and 6. Tube 72 provides a convenient arm support and attachment structure. The arm assemblies may be added or removed during assembly or in the field. Casting 87 is merely slipped on before the knobs are installed and secured to the housing. Screws passing through the undersurface of the castings and into the housing may be used.

Grouping of the controls by function reduces confusion in use. The adjustable subassemblies of the chair may be operated while the user is positioned in the seat. The controls provide visual cues and tactile feedback during use. The ergonomic benefits resulting from the adjustability features are more easily and readily achieved.

Figure 5:
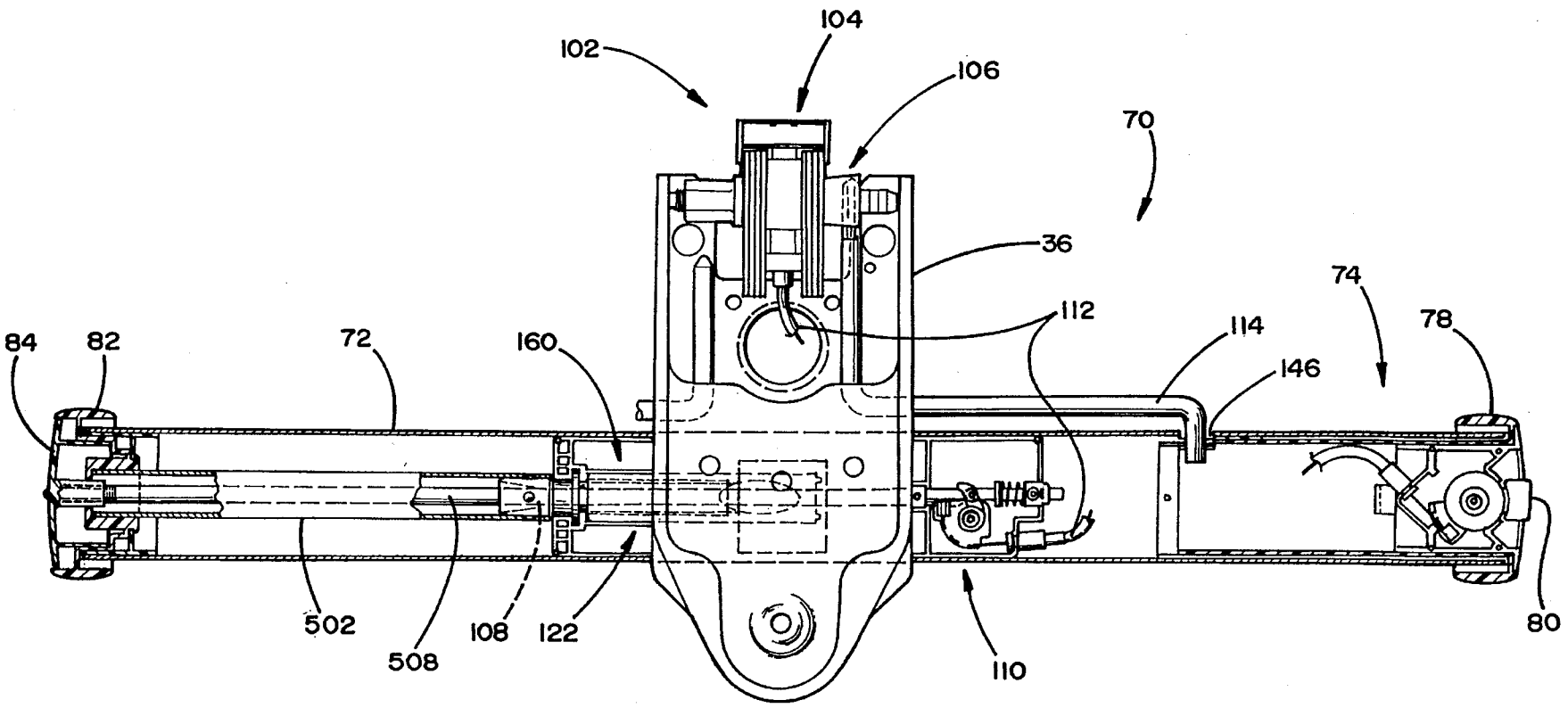
FIG. 5 is a fragmentary, top view of the chair control and actuator subassembly in accordance with the present invention.

As seen in FIGS. 5 and 6, actuator subassembly 70 is attached to the undersurface and forward portion of control housing 36. A variable back stop and seat tilt adjustment subassembly 102, including a back stop portion 104 and a seat tilt portion 106, is supported on control housing 36 at the rear thereof. The variable back stop portion 104 of the subassembly is controlled by push button 84 and an actuator including a push rod 108, a rotor subassembly 110 and a cable subassembly 112. The seat tilt portion 106 of subassembly 102 is actuated through a configured control rod 114 operated by knob 78.

The back tension or preload exerted on the back support uprights 32, 34 by the storage device 46 is adjusted by an actuator subassembly 122. Subassembly 122 engages an adjustment link or pull rod 124 (FIG. 6) which, in turn, engages a forward portion 126 of energy storage device 46. The individual subassemblies mounted within the actuator 70 are described separately below.

The actuator subassembly permits packaging of control features. The subassembly could be used with a variety of different chairs. The subassembly is modular or pivotable in nature and provides an interchangeable assembly usable on a variety of chairs with different features without substantial modification.

Actuator Housing and Inner Support

Actuator housing 72 is illustrated in FIGS. 7–11. As shown therein, housing 72 is an elongated, tubular member. In the presently preferred form, housing 72 has a circular cross section. The cross section of the housing could vary, as would be readily apparent to one of ordinary skill in the art, without changing the function or resulting in a nonequivalent structure. Housing 72 includes a centrally positioned, generally rectangular aperture 130 dimensioned to accommodate a portion of the seat tension adjustment subassembly, as described in detail below. Housing 72 is further formed with a series of screw apertures 132, 134, 136, 138, 140 and 142. As shown in the assembly drawings, screws secure individual components to the housing. Alternatively, suitable snap-fit retainers could be used in a similar fashion. Tube 72 defines a cable slot 144 and an actuator rod slot 146. Strap retention slots 148, 150 are formed on the forward face and the rearward face of tube 72. Other forms of removable or permanent methods of attachment could be used besides the retention strap which cooperates with slots 148, 150.

As seen in FIGS. 5 and 6, an inner support or housing subassembly 160 is positioned centrally of housing 72. The inner support includes an upper support or half 162 and a lower support or half 164. Upper and lower supports are configured to mate and define a generally tubular, inner support or housing which contains and supports the various components incorporated in the different actuators and adjustment subassemblies. Upper support 162 defines a semicircular well 168 adjacent end 166. The support is formed with actuator support bosses 172, 174, locator pins 176 and locator holes 177. A central area 178 defines a slot 180 and a ramp guide area 182. Lower support 164 defines control support bosses 184, 186 and 188. Control bosses 186, 188 are complimentary to and juxtaposed with bosses 172, 176 of upper support 162. An end 192 defines a semicircular well 194 which compliments well 168. The support further defines a central area 196 having a generally flat or horizontally extending base 198. Lower support 164 is also formed with locator pins 176 and holes 177, which cooperate with the locator pins 176 and holes 177 on upper support 162. It is presently preferred that the upper and lower inner support members be fabricated from a suitable engineering plastic using conventional molding techniques.

Figure 18:
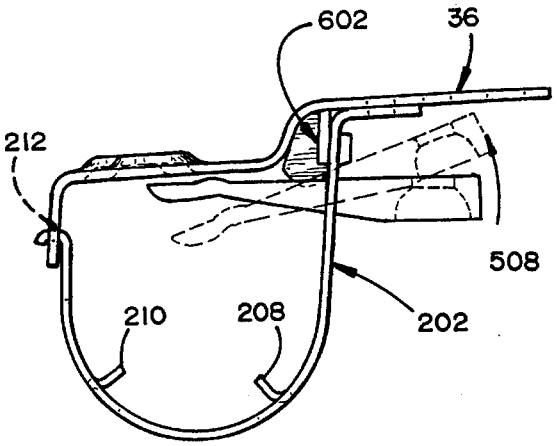
FIG. 18 is an elevational view showing the attachment of the strap of FIG. 12 to the pan or undersurface of a chair control.
Figure 16:
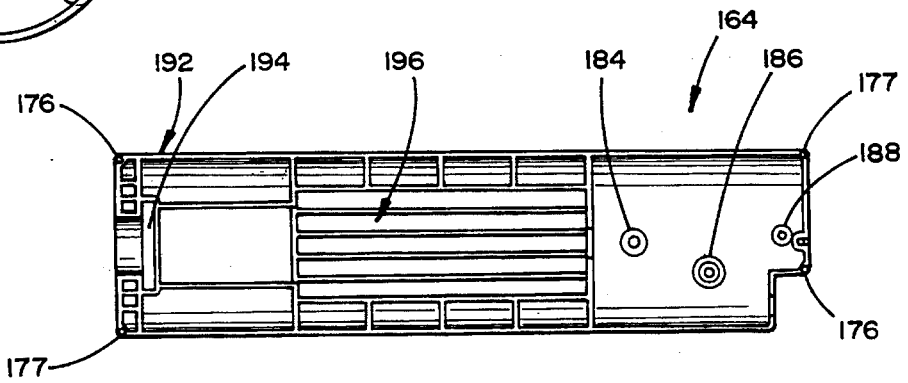
FIG. 16 is a top, plan view of the lower half of the inner support incorporated in the present invention.
Figure 17:
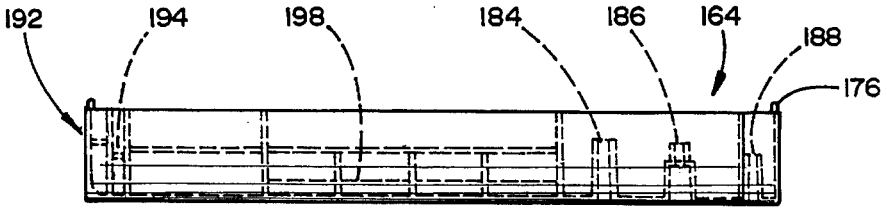
FIG. 17 is a side elevational view of the support of FIG. 16.

Assembly 70 is preferably mounted on an undersurface of control housing 36 by an attachment strap or bracket 202. Strap 202 is generally U-shaped in cross section and defines a hooked leg 204, an attachment flange 206 and inwardly bent, lanced tabs 208, 210. As seen in FIG. 18, hook portion 204 of strap 202 is received in a slot 212 defined by control housing 36. Attachment flange 206 is secured to an undersurface of housing 36 or to a bracket welded thereto by suitable fasteners passing through apertures 214. Tabs 210, 208 are received within slots 148, 150 defined by tube 72. Slots 148, 150 are spaced with respect to each other about an arc on tube 72. Tabs 208, 210 retain tube 72 and prevent rotation thereof with respect to the chair control. Strap 202 further defines a centrally positioned aperture 218 which, along with aperture 130 of tube 72 and slot 180 of support 162, accommodates portions of the seat tension subassembly, as explained in more detail below.

Adjustable Back Stop Subassembly

Figure 19:
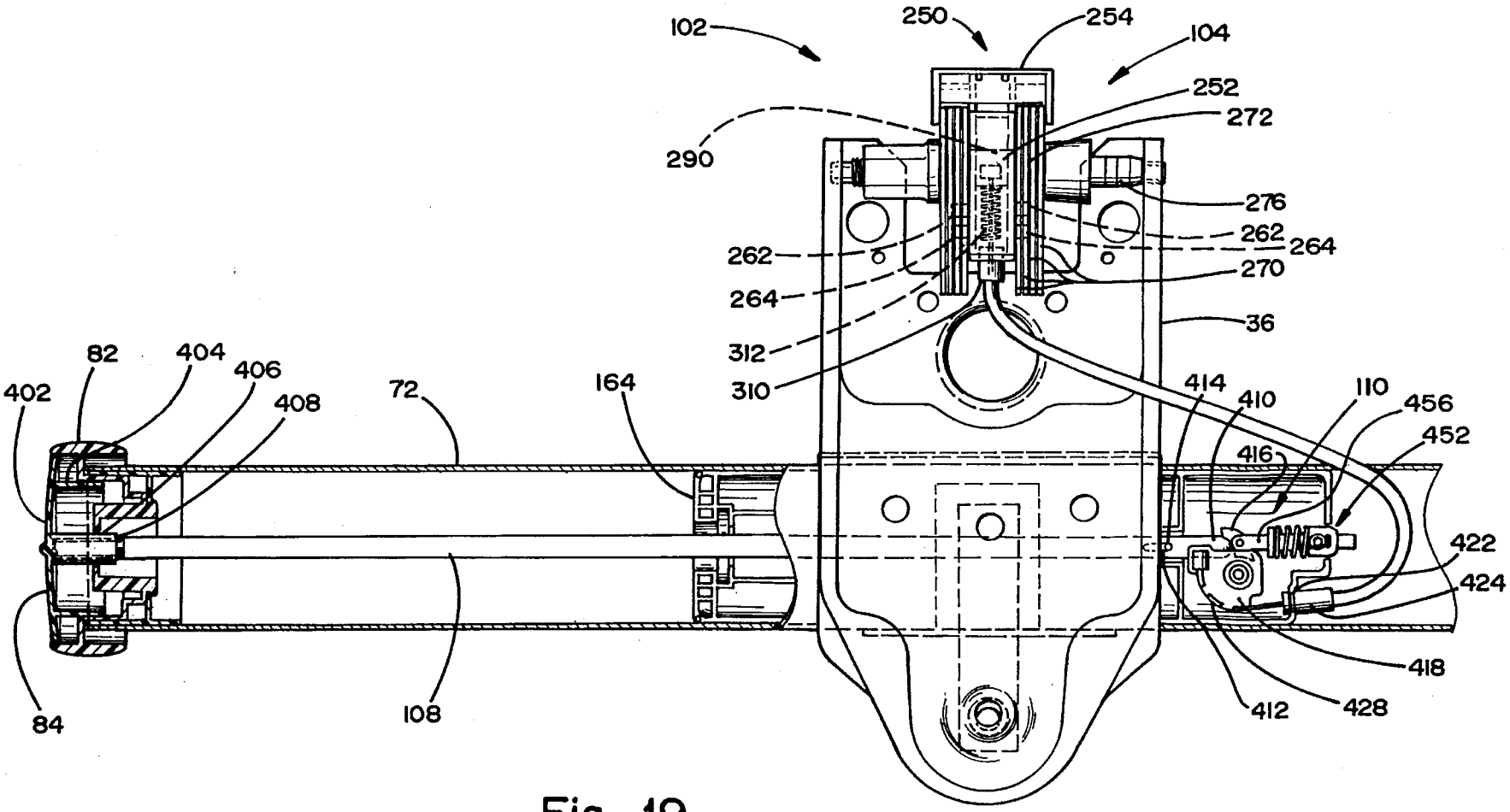
FIG. 19 is a fragmentary, top, plan view of a back stop subassembly and actuator in accordance with the present invention.
Figure 20:
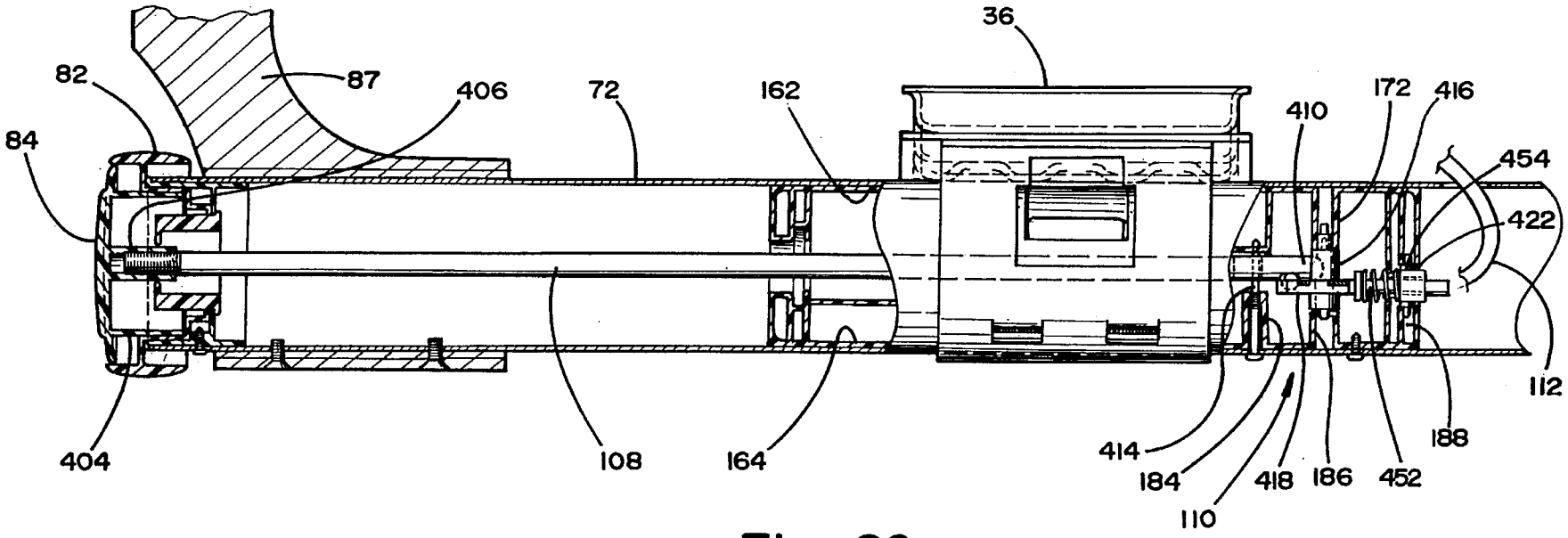
FIG. 20 is a front, plan view of the subassembly of FIG. 19.
Figure 21:
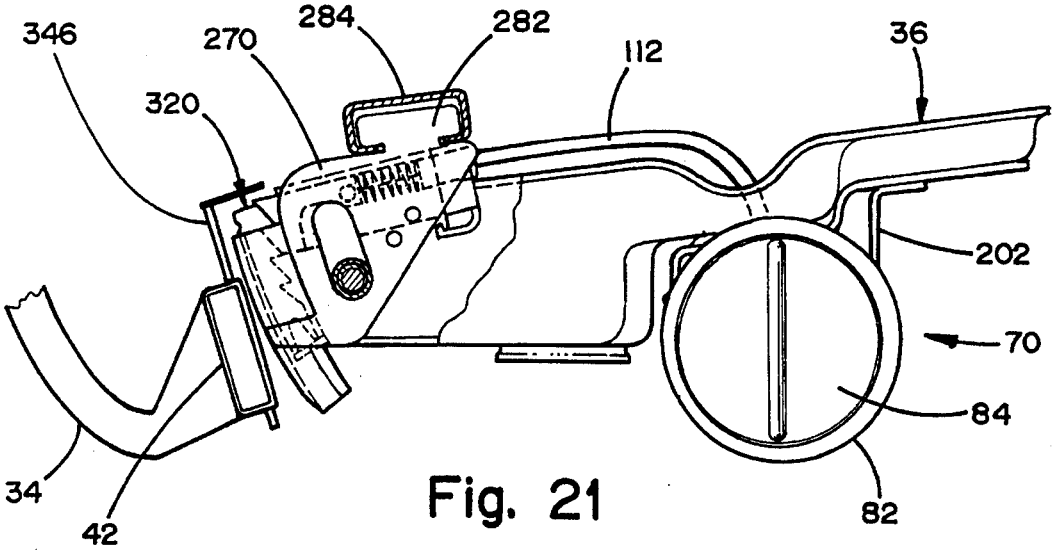
FIG. 21 is a side, elevational view of the subassembly of FIG. 19.
Figure 24:
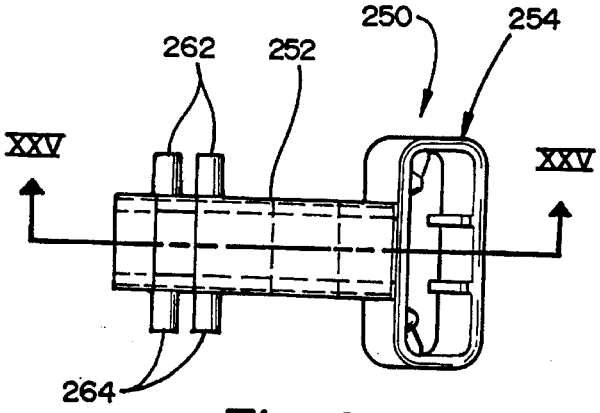
FIG. 24 is a top, plan view of a housing incorporated in the variable back stop.
Figure 28:
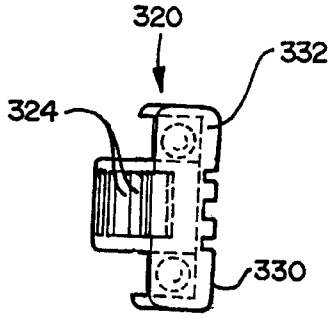
FIG. 28 is a top view of a plunger or stop incorporated in the variable back stop subassembly.
Figure 25:
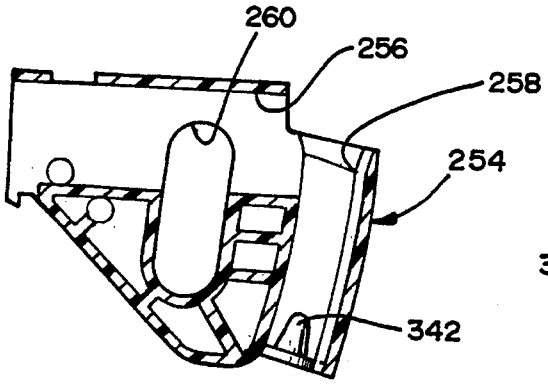
FIG. 25 is a cross-sectional view taken generally along line XXV—XXV of FIG. 24.
Figure 29:
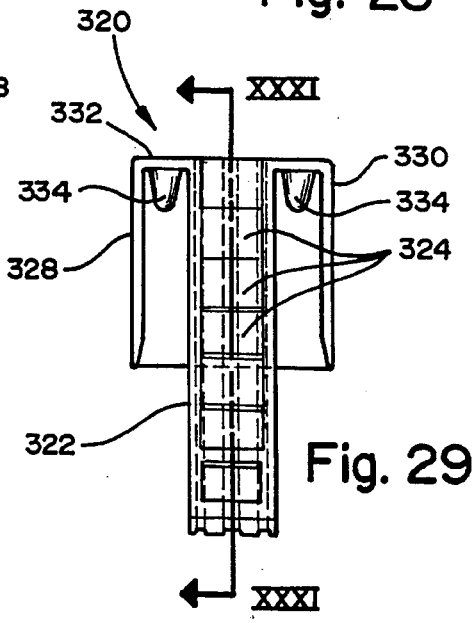
FIG. 29 is a rear, elevational view of the stop of FIG. 28.
Figure 26:
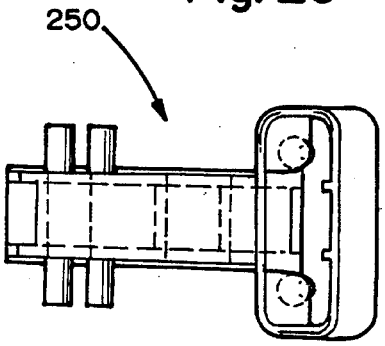
FIG. 26 is a bottom view of the housing of FIG. 24.
Figure 31:
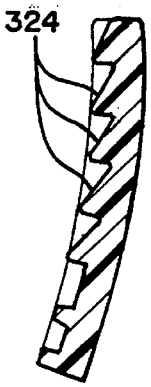
FIG. 31 is a cross-sectional view taken generally along line XXXI—XXXI of FIG. 29.
Figure 30:
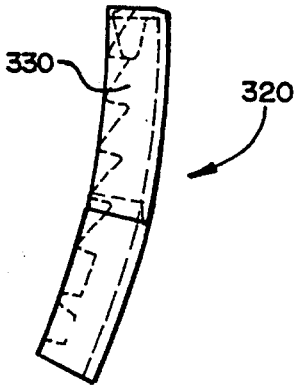
FIG. 30 is a side, elevational view of the stop of FIG. 28.
Figure 27:
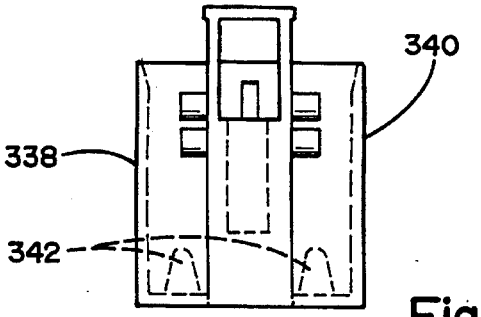
FIG. 27 is a front elevational view of the housing of FIG. 24.

FIGS. 19–21 illustrate the adjustable back stop subassembly and related actuator incorporated in the present invention. The other actuators, seen in FIGS. 5 and 6, have been eliminated from these views so that the drawings may be more easily understood. The adjustable back stop subassembly portion 104 of overall back stop and seat subassembly 102 includes a housing 250. Housing 250 is generally T-shaped in plan view, as seen in FIGS. 19, 24 and 26. Housing 250 includes a central portion 252 and an arm portion 254. Central portion 252, as best seen in FIG. 25, defines a plunger bore 256. Arm portion 254 defines a central stop bore 258. Central portion 252 further defines opposed slots 260 and outwardly extending pins 262, 264 on each side thereof. Housing 250 is adapted to be supported by seat lock plates 270 of the seat tilt subassembly portion 106. Seat lock plates 270 are interposed with lock washers 272 positioned on an axle 276. Axle 276 is supported on control housing 36. Locking plates 270 include generally T-shaped portions 282 which are received within a seat bracket 284. Bracket 284 is secured to the undersurface of the chair seat 14. When the clutch plates and lock washers are released, seat support bracket 284 may be moved upwardly and downwardly with respect to lock axle 276. Housing 250 through pins 262, 264, as seen in FIG. 19, is attached to adjacent locking plates 270. As the seat tilt is adjusted, housing 250 will also be adjusted relative to the chair base. The basic operation and construction of the seat tilt assembly 106 of subassembly 102 forms the subject matter of commonly owned, copending U.S. patent application Ser. No. 07/852,306 entitled CHAIR WITH BACK LOCK, filed on Mar. 18, 1992, in the name of Steffens et al., the disclosure of which is hereby incorporated by reference.

Figure 22:
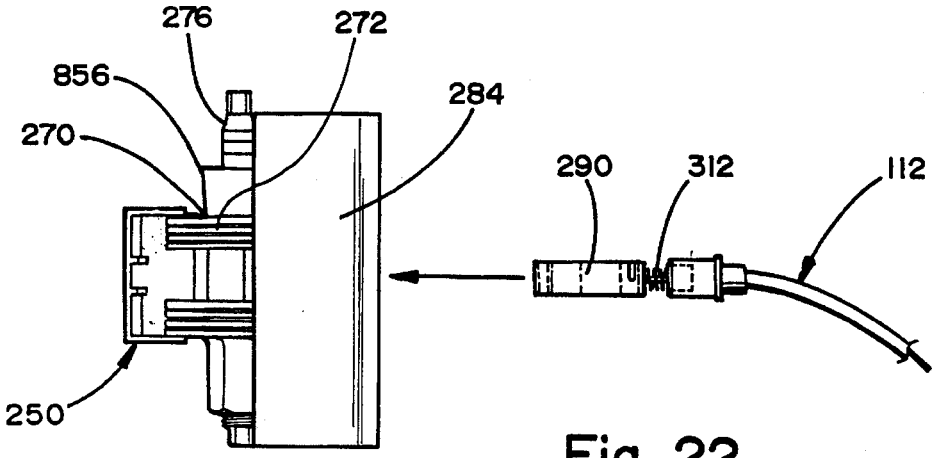
FIG. 22 is an exploded, top plan view of a portion of the variable back stop subassembly.
Figure 23:
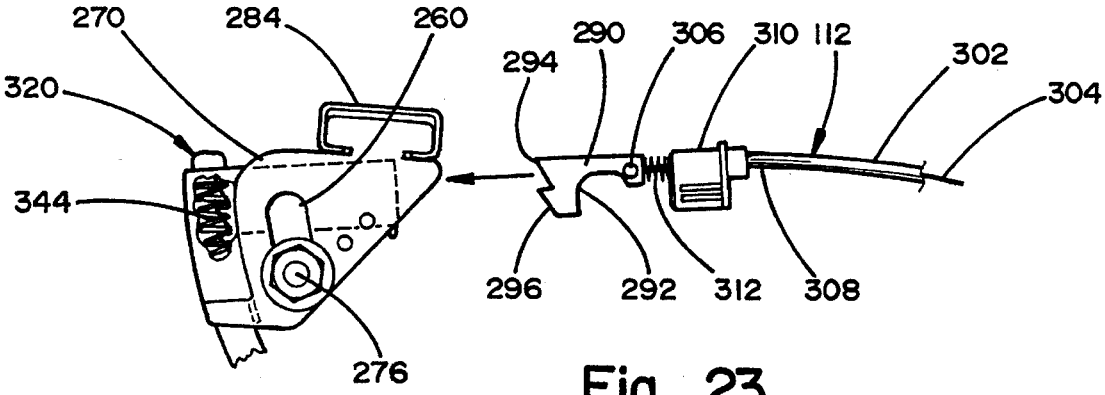
FIG. 23 is an exploded, elevational view of a portion of the variable back stop subassembly.

As best seen in FIGS. 21–23, a plunger 290 is slidably mounted within plunger housing or bore 256. Plunger 290 defines a slot 292 which compliments slot 260 and permits full movement of slot 260 about axle 276. A forward end of plunger 290 has a locking surface which defines stepped teeth 294, 296. Cable subassembly 112 includes an outer housing 302 and an inner cable 304. Cable 304 has an end 306 secured to plunger 290. Housing 302 includes an end 308 received in an end fitting 310. A coil spring 312 is interposed between fitting 310 and plunger 290. When plunger 290 and cable fitting 310 are slid into bore 256, fitting 310 snaps onto and is fixed to housing 250, and spring 312 exerts a resilient, biasing force which biases plunger 290 into stop bore 258.

A stop 320 is disposed within stop bore 258. As seen in FIGS. 28–31, stop 320 includes a central portion 322 which defines a rack or a plurality of teeth 324. Teeth 324 are configured to be complimentary to the teeth 294, 296 on plunger 290. Spring retention housings 328, 330 extend from lateral sides of the central plunger portion 322. The housings define an upper stop surface 332 and spring retainment bosses 334.

Plunger portion 254 of housing 250 also defines spring retention housings 338, 340 having spring retention bosses 342. Coil springs 344 (FIG. 23) are positioned within each housing 338, 340. Plunger 320 is then positioned within bore 258. The springs engage bosses 334 and resiliently bias the stop plunger 320 to a fully extended position relative to housing 250. As seen in FIG. 21, when plunger 290 is in an extended or operative position, teeth 294, 296 engage teeth 324 on the stop, thereby locking the stop in position with respect to housing 250.

As seen in FIG. 21, a stop bracket 346 is welded or otherwise suitably attached to crosspiece 42 of the back support subassembly. The back of the chair will tilt, therefore, until stop 346 engages stop 320 of the adjustable back stop subassembly. With the seat in a fully upright position, cable subassembly 112 may be actuated to pull plunger 290 against the resilient bias of spring 312, thereby releasing stop plunger 320 with respect to the housing. The chair may be tilted rearwardly until a desired position is reached between a fully upright and a fully reclined position. The plunger can then be released so that it moves into engagement with teeth 324 of stop 320. A new maximum tilt position will, therefore, be selected.

In accordance with the preferred form of the actuator assembly, plunger 290 is moved between its operative and inoperative or engagement and disengagement positions by push button 84, push rod 108 and rotor subassembly 110. These elements, including the cable subassembly, could be used to actuate a back lock subassembly as opposed to the adjustable back stop subassembly of FIGS. 21–23. An example of a back lock is found in the aforementioned U.S. patent application Ser. No. 07/852,306. In addition, such elements could actuate a variable back stop of the type disclosed in U.S. Pat. No. 5,282,670 entitled CABLE ACTUATED VARIABLE STOP MECHANISM, which issued on Feb. 1, 1994, to Karsten et al. Also, plunger 290 could be shifted by a cable assembly including a button subassembly as disclosed in U.S. Pat. No. 5,282,670, the disclosure of which is hereby incorporated by reference.

As seen in FIGS. 19 and 20, push button 84 includes an outer circular face 402 and an inner, circular cup portion 404. Cup portion 404 is slidably mounted within and engages rotor knob 82. Push button 84 further includes a central push rod attachment portion 406 which defines a bore 408. Push rod 108 has a knurled portion which extends into and is attached to push button 84 at bore 408. The opposite end 410 of push rod 108 engages rotor subassembly 110. Rod 108 is formed with an elongated slot 412 (FIG. 19). A retention pin 414 extending through boss 184 on the lower inner housing or support extends into slot 412. The pin and slot, therefore, limit outward movement of button 84 with respect to housing 72. The push rod and button will retain knob 82 on housing 72. The pin, which is threaded to boss 184, may be removed permitting disassembly of the actuator in the field.

End 410 of rod 108 engages a configured lever portion 416 of a rotor, lever or bellcrank 418. Rotor 418 is mounted on boss 186 of lower inner support 164. Rotor 418 is captured by upper boss 172 and, hence, mounted for rotation or pivoting action within the inner support housing. As seen in FIGS. 19 and 20, the inner supports 162, 164 define an attachment aperture 422 which receives a slotted end of cable housing attachment 424. In this fashion, cable housing 302 is fixed with respect to the inner support housing. Cable 304 is attached to rotor 418 along an arc or curved section 428. As should be apparent, rotation of rotor 418 in a clockwise direction, when viewed in FIG. 19, will pull on cable 304 thereby moving plunger 290 to its inoperative or disengaged position. Such rotary motion occurs upon inward pushing of button 84 through push rod 108. When button 84 is released, spring 312 would tend to rotate rotor 418 in a counterclockwise direction returning button 84 to its fully outward position relative to housing 72.

In accordance with the present invention, provision is made for retaining rotor 418 in a rotated position, thereby disengaging the plunger and then selectively releasing the rotor upon an additional inward movement of push button 84. A catch or lock subassembly 452 is supported on bosses 174, 188 of the inner support housing. As seen in FIGS. 19, 20 and 32–42, catch subassembly 452 is a push on/push off device which includes a catch housing 454 mounted on support boss 188. Housing 454 supports a catch plunger or slide 456. Plunger 456 includes an end 458 which is pivotally attached to rotor 418. A lock pin 460 in the form of a configured member formed from music wire is positioned on housing 452. Wire 460 includes a lock or catch pin portion 462 and a configured portion 464. A coil spring 466 is interposed between housing 454 and a flange 468 formed on plunger 456. The coil spring engages configured portion. 464 of music wire 460. The spring holds the music wire on the support housing and assists in retaining lock pin portion 462 within a bore 470. Spring 466 resiliently biases the plunger outwardly with respect to housing 454 to the position illustrated in FIGS. 19 and 32.

An upper surface 474 of plunger 456 defines a stepped and ramped track 476. Track 476 is ramped, and the depth of the track with respect to surface 474 varies as the lock pin moves along the track. When plunger 456 is in the position shown in FIG. 32, lock pin 462 is positioned in the apex 477 of a V-shaped portion 478 of the track 476. As the push rod pivots rotor 418, lock pin 462 will align the ramps of track 476 into another apex 486 of the track. The lock pin is held in position in the apex by spring 466. The pin can be released from the apex and caused to travel around the track 476 to apex 477 by again moving plunger 456 inwardly. The inward motion causes the pin to step along ramps to apex 477. Track 476 includes portions 475, 479, 481 and 483. The track has a depth of 0.060 inches at point A, 0.020 inches at point B, 0.035 inches at point C, 0.050 inches at point D, 0.055 inches at point E, 0.070 inches at point F and 0.045 inches at point G. The varied depth causes the catch pin to travel in only one direction around the track.

Plunger 456 also defines a guide slot 499 in surface 474. Leg 501 of wire member 460 extends through a bore 503 in housing 454 and into guide slot 499.

The catch subassembly 452 is an available item. Its operation results in actuator button 84 having to be pushed to release the plunger and pushed to allow spring 312 to return the plunger to its engaged or operative position. The click on/click off or push on/push off action of the rotor and catch subassembly allows the plunger to be retained in a disengaged position so that full tilting action of the chair may be achieved.

Back Tension Subassembly

The back tension subassembly and actuator structure in accordance with the present invention is illustrated in FIGS. 43–59. The subassembly includes rotating knob 82, a tubular member 502, a lead screw 504, a ramp subassembly 506, an actuating lever 508 and a pull rod or link subassembly 510. Link 510, as seen in FIGS. 44 and 45, includes a nut 512 which engages portion 126 of the torsional energy storage device 46. Vertical movement of pull rod or link 510, therefore, will adjust the preload which storage device 46 exerts upon back uprights 32, 34 and, hence, the initial force required to tilt the seat back. Link 510 is moved through ramp subassembly 506 and lever 508.

Figure 43:
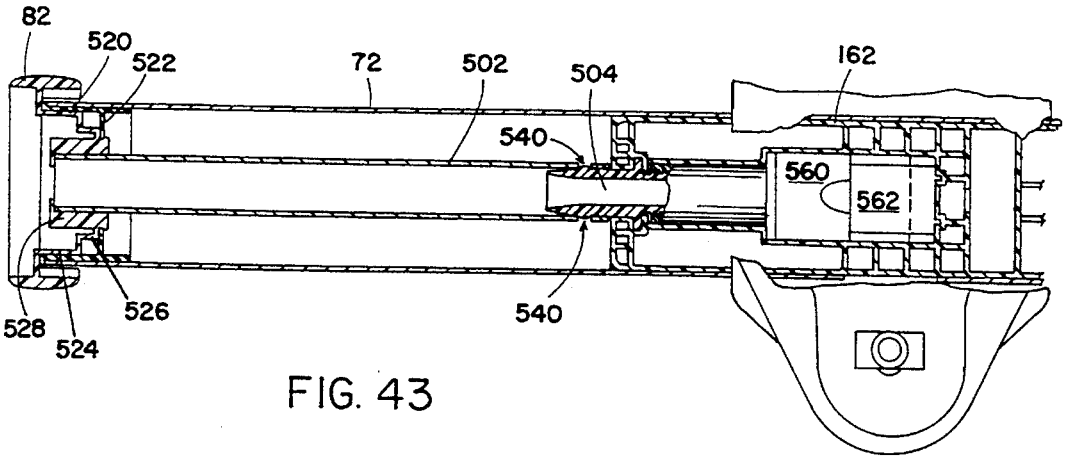
FIG. 43 is a fragmentary, top view of the tension adjustment subassembly in accordance with the present invention.
Figure 44:
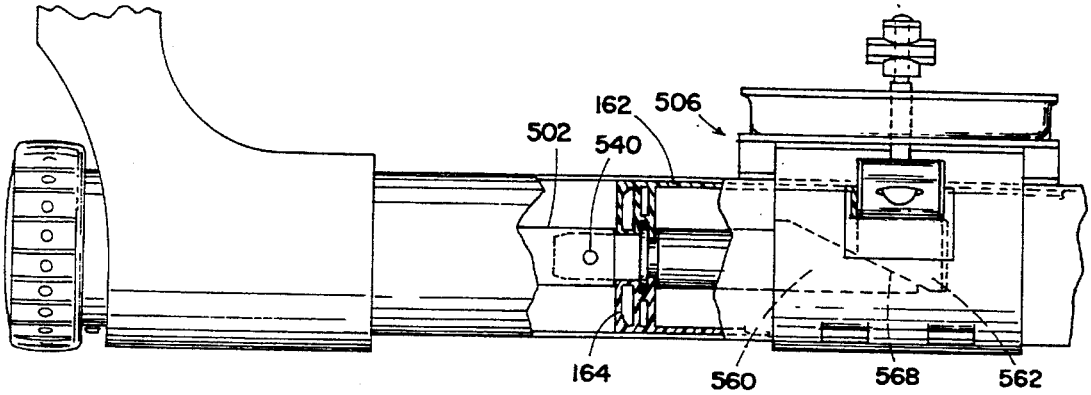
FIG. 44 is a fragmentary, front, elevational view of the subassembly of FIG. 43.
Figure 45:
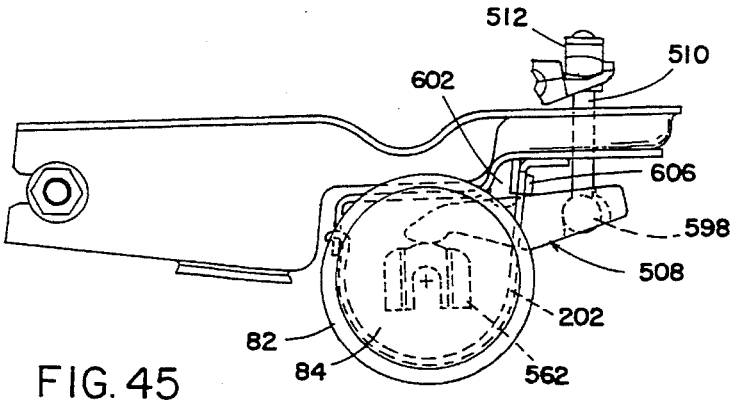
FIG. 45 is a side, elevational view of the subassembly of FIG. 43.
Figure 46:
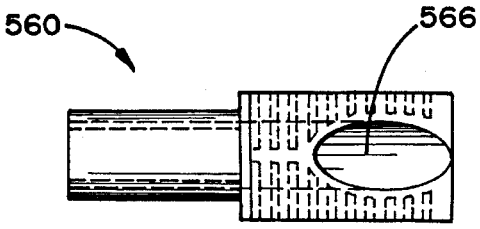
FIG. 46 is a top, plan view of a first or lower ramp incorporated in the subassembly of FIG. 43.

As seen in FIGS. 43 and 44, a generally circular housing 520 is disposed within the end of tube 72. Housing 520 defines an annular flange 522. Annular flange 522 defines a stop surface against which knob 82 rotates. Knob 82 has a stepped, cup-shaped configuration in cross section. A first circular wall 524 engages inner surface of housing 520. An end of a second stepped portion 526 engages the bearing surface of annular flange 522. Knob 82 also includes a noncircular, cup-shaped portion 528 defining a bore 529. Tube 502 is rectangular dr noncircular in cross section. The tube is disposed in bore 529. As a result, rotation of knob 82 will rotate tube 502. Also, as seen in FIG. 5, push rod 108 of the back stop adjustment subassembly passes through the interior of tube 502 to its point of engagement with rotor subassembly 110.

Figure 58:
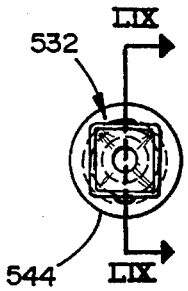
FIG. 58 is an end view of the lead screw.
Figure 57:
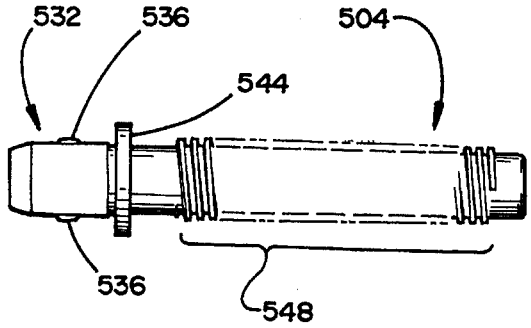
FIG. 57 is an elevational view of a lead screw incorporated in the subassembly of FIG. 43.
Figure 59:
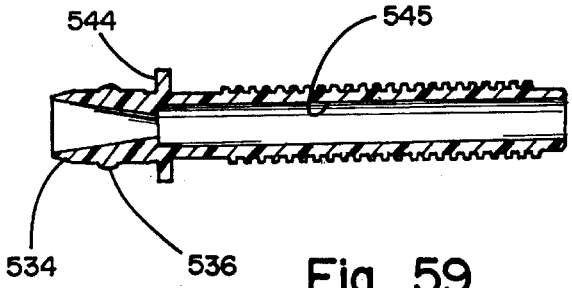
FIG. 59 is a cross-sectional view taken generally along line LIX—LIX of FIG. 58.

Lead screw 504, as seen in FIGS. 57–59, includes an attachment end 532 having a tapered bore 534 and peripheral beads or bumps 536. As seen in FIG. 58, attachment end 532 is also noncircular in cross section and configured to be received in tube 502. Bumps 536 snap in a detent fashion into holes 540 formed in tube 502. Rotation of the tube 502 will, therefore, rotate the lead screw 504.

Lead screw 504 includes an annular flange 544. The annular flange 544 is disposed within the semicircular housings defined by upper and lower inner supports 162, 164. The housings capture the circular flange. Lead screw 504 further defines a threaded portion 548. The threads are formed integral with the lead screw. The lead screw may be molded from a suitable nylon resin.

Ramp subassembly 506 includes a first or lower ramp 560 and an upper or second ramp 562. Ramp 560 includes an internally threaded tubular portion 564. Internal threads 566 are threadably received or mate with threads 548 of lead screw 504. Ramp 560 includes an angled surface 568. Surface 568 extends at an angle of approximately 25-degrees from horizontal. Ramp 560 is molded from an acetal resin.

Ramp 560 is captured by upper and lower inner supports 162, 164 and is retained for sliding movement on surface 198. As should be apparent, rotation of knob 82 translates into horizontal movement of lower ramp 560 along lead screw 504. The mating threads are selected so that rotation of knob 82 in a clockwise direction when viewed in FIG. 4 moves ramp 560 to the right when viewed in FIG. 44. The horizontal movement of ramp 560 is converted to vertical movement through sliding engagement with the second ramp 562.

Figure 49:
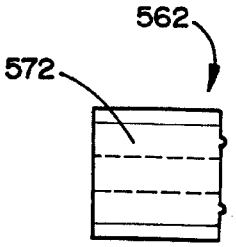
FIG. 49 is a top, plan view of a second or upper ramp.
Figure 48:
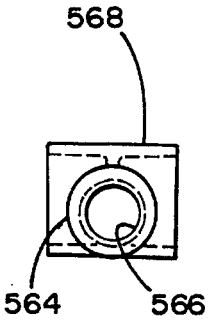
FIG. 48 id an end, elevational view of the ramp of FIG. 46.
Figure 47:
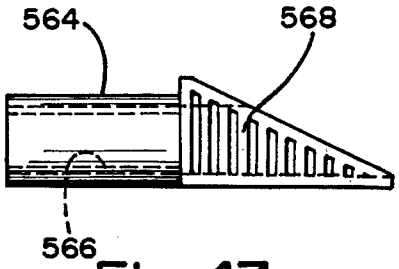
FIG. 47 is a side, elevational view of the ramp of FIG. 46.
Figure 50:
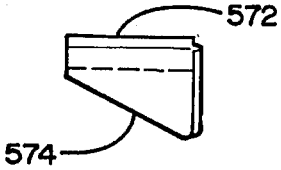
FIG. 50 is a side, elevational view of the ramp of FIG. 49.
Figure 51:
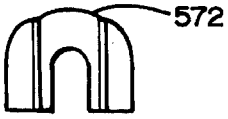
FIG. 51 is an end view of the ramp of FIG. 49.

As seen in FIGS. 49–51, ramp 562 defines an upper lever contact surface 572 and side, angled ramp surfaces 574. Surfaces 574 are angled complimentary to ramp surface 568 defined by the first ramp 560. The second ramp 562 is retained within the housing defined by the upper and lower support halves and by the guide flanges defined by the upper half. Also, as seen in FIGS. 57–59, lead screw 504 defines an inner bore 545. Push rod 108 extends through the inner bore of lead screw 504. Ramp 562 is molded from a nylon resin.

Figure 52:
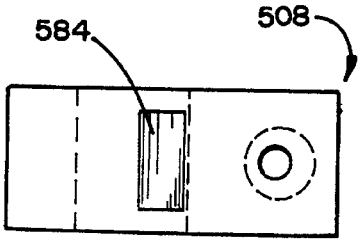
FIG. 52 is a top, plan view of a tension adjustment lever.
Figure 53:
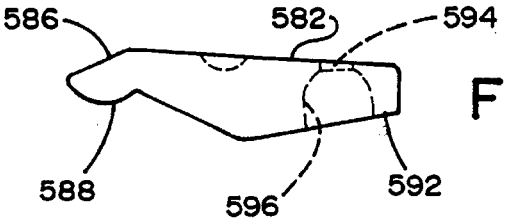
FIG. 53 is a side, elevational view of the tension adjustment lever.

Lever 508, as seen in FIGS. 52, 53, includes an upper surface 582 which defines a semicircular recess 584. One end 586 of lever 508 defines a finger-like portion having a semicircular curve 588 at a lower end. The curved surface 588 engages and rides on lever surface 572 of second ramp 562. A forward end 592 of lever 508 defines an aperture 594 which opens into an enlarged ball socket 596. As seen in FIG. 45, a lower end 598 of pull rod or link 510 is formed spherical or ball shaped and is retained within socket 596. Lever 508 is positioned so that it extends through the rectangular apertures formed in support strap 202 and main actuator tube or outer housing 72.

Figure 13:
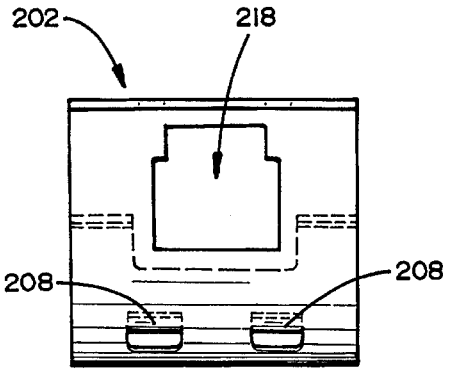
FIG. 13 is a front, elevational view of the strap of FIG. 12.
Figure 54:
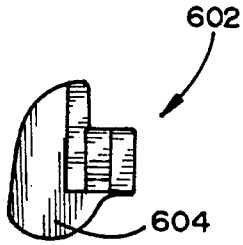
FIG. 54 is an end, elevational view of a lever support.
Figure 55:
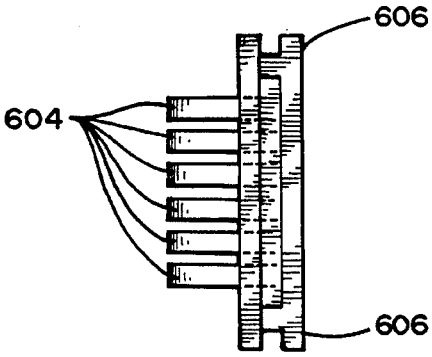
FIG. 55 is a top view of the lever support of FIG. 54.
Figure 56:
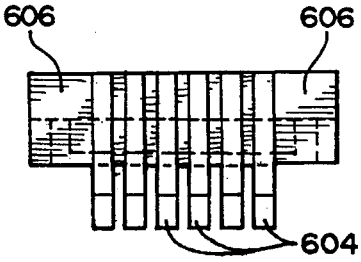
FIG. 56 is a rear view of the lever support.

A pivot point or support for the lever is defined by a member 602, shown in FIGS. 54–56. Member 602 includes a plurality of curved or configured portions 604. Portions 604 are configured to be received within the semicircular groove or recess 584 defined in the upper surface of lever 508. Support 602 includes outwardly extending arms 606. Arms 606 are configured to be received within a reduced width portion of slot 218 in strap 202. The reduced width portion is seen in FIG. 13. When in the position as shown in FIG. 18, support 602 provides a bearing surface for lever 508. Support 602 is molded from a nylon resin, and lever 508 is formed from steel.

As should be readily apparent, rotation of knob 82 in a clockwise direction rotates the lead screw to shift the first ramp to the right when viewed in FIG. 44. This movement shifts ramp 562 upwardly causing lever 508 to rotate in a clockwise direction about member 602 pulling downwardly on pull rod 510 which increases the initial set point or preload of the torsional energy storage device 46. The back tension subassembly and actuator in accordance with the present invention permit ready adjustment of the tension of the chair control while the user is seated by being located for easy use at the same hand location. Previous tension adjustments included a threaded bolt which is hidden under the chair. A majority of the users would not even know that a tension adjustment was provided in the chair. The subject rotating knob arrangement provides ready tactile and visual feedback and a visual cue to adjust tension by rotation in a clockwise direction. The control can be viewed by the user due to the positioning of the knob laterally of the seat of the chair. The function of the knob becomes intuitive due to its position. The rotation of the control knob ties to the tilting or rotating nature of the chair tilt action.

Seat Depth Subassembly

Figure 60:
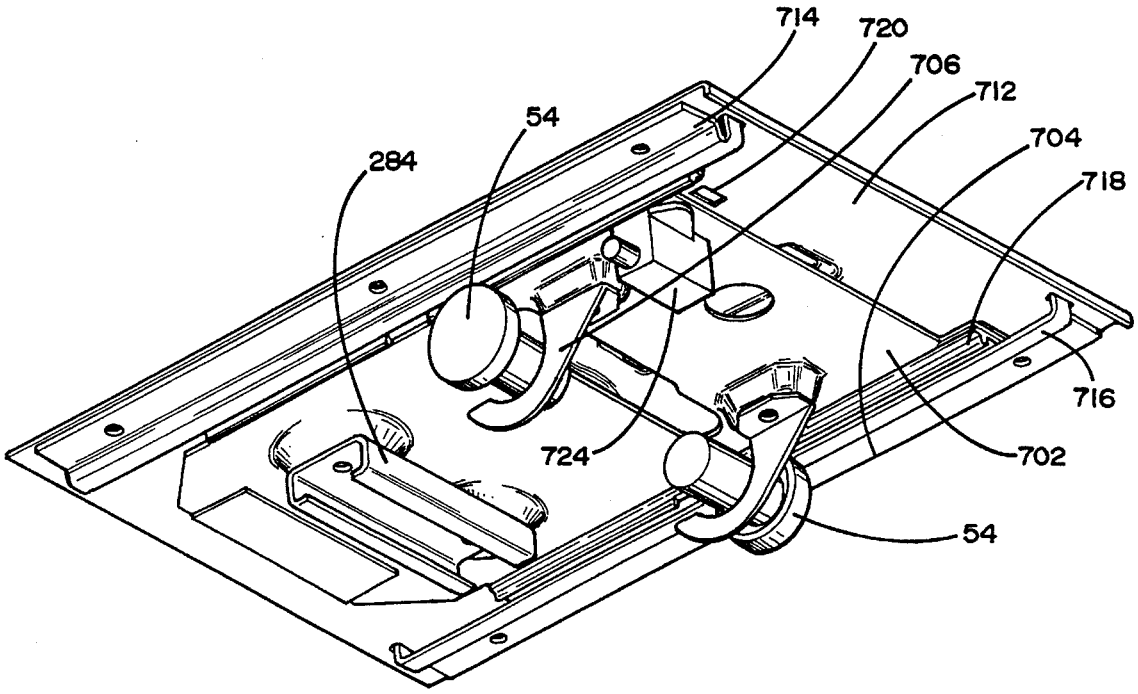
FIG. 60 is a perspective view of a seat depth adjustment subassembly.

A seat depth adjustment feature may be incorporated in the chair of the present invention. As shown in FIG. 60, a plate 702 is provided in the seat subassembly 14. Plate 702 includes hooked portions 704, 706 which are positioned about bushings 54. The seat bracket 284 of the seat tilt adjustment subassembly is fixed to an undersurface of plate 702. Plate 702 will pivot about the axles of energy storage device 46 as discussed in more detail below and as more fully set forth in the aforementioned U.S. application Ser. No. 07/852,306.

A slidable seat plate 712 is slidably mounted on plate 702 by a guide 714 which retains rails 716 on glides 718 carried on the lateral edges of plate 702. Guide 714 has been removed from one side of the figure so that the rail 716 can be seen. Plate 712 defines a series of tandemly arranged slots or holes 720. Plate 712 may be fixed in position with respect to plate 702 through a lock pin subassembly 724.

Figures 61, 62, 63:
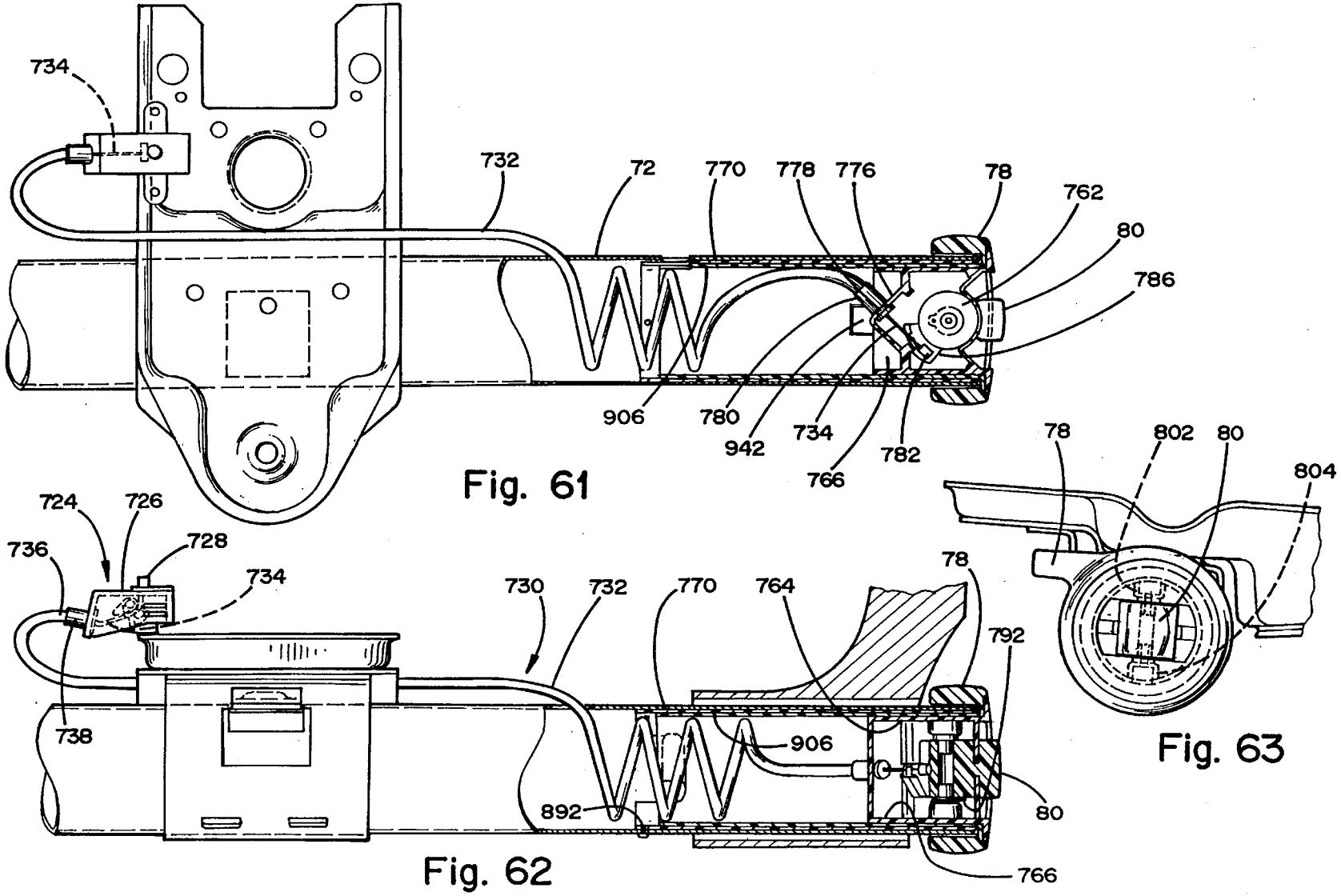
FIG. 61 is a fragmentary, plan view of the seat depth adjustment actuator subassembly in accordance with the present invention.
FIG. 62 is a fragmentary, front, elevational view of the subassembly of FIG. 61.
FIG. 63 is an end, elevational view of the subassembly of FIG. 61.
Figure 64:
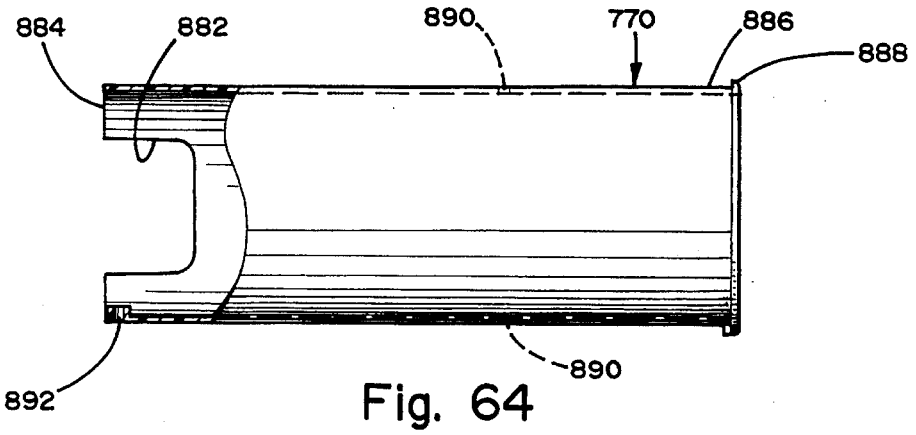
FIG. 64 is an elevational view of a sleeve disposed in the right side of the actuator tube or housing of the subassembly of FIG. 61.
Figure 65:
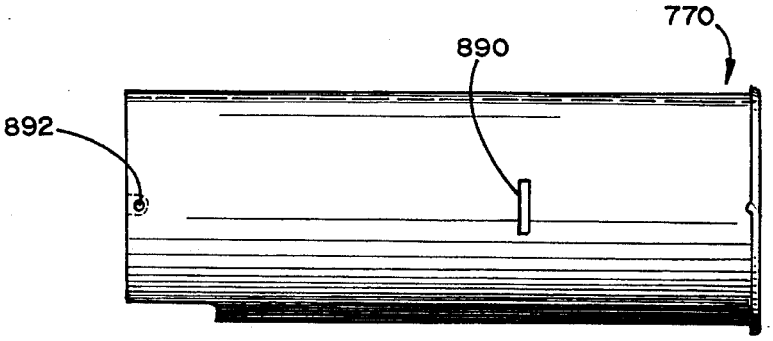
FIG. 65 is a bottom, plan view of the sleeve of FIG. 64.
Figure 66:
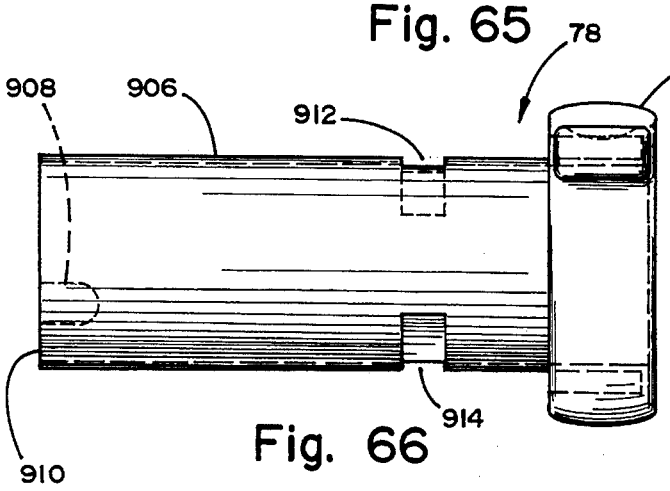
FIG. 66 is an elevational view of a rotary actuator.
Figure 67:
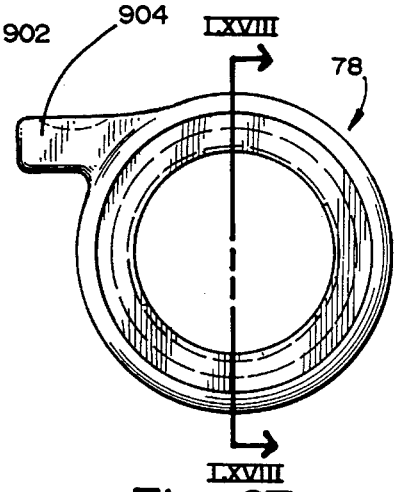
FIG. 67 is an end, elevational view of the rotary actuator of FIG. 66.
Figure 68:
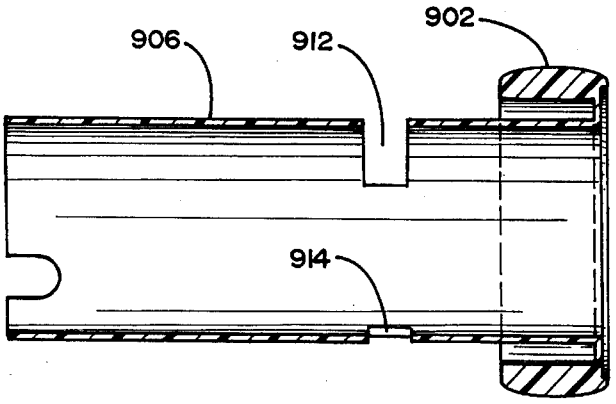
FIG. 68 is a cross-sectional view taken generally along line LXVIII—LXVIII of FIG. 67.

As seen in FIGS. 6, 61 and 62, lock pin subassembly 724 includes a housing 726 and a rotatably mounted pin 728. A cable subassembly 730, including an outer housing 732 and a cable 734, is also provided. An end 736 of housing 732 is attached to a fitting 738 fixed at housing 726. Cable 734 is attached to pin 728. Pulling movement of cable 734 will rotate pin 728 downwardly out of one of the slots 720 permitting plate 712 to be shifted in a front-to-back or fore-and-aft direction with respect to plate 702. This permits the seat cushion to be shifted toward or away from the back thereby adjusting the seat depth for the user. Pin 728 is positioned through the button or rotating actuator 80 at end 74 of assembly 70. Actuator 80, as seen in FIGS. 61–63, includes a generally circular portion 762 in plan. Actuator or button 80 is rotatably mounted within a housing subassembly defined by upper and lower housing halves 764, 766. As explained in more detail below, the housing halves are retained on tube 72 in cooperation with rotary actuator 78 and an inner sleeve 770. The housing halves also serve to retain actuator 78 on the end of tube 72.

Housing halves 764, 766 define a wall 776 having a slot 778. Slot 778 receives cable fitting 780 to fix the cable housing with respect to actuator button 80. An end 782 of cable 734 is attached to actuator button 80 at a cable attachment portion 786. As seen in FIGS. 62, 63, 69 and 69A, housing halves 764, 766, which are identical in shape, define support bosses 802 which capture and rotatably mount actuator button 80. Each half includes a semicircular sidewall 803 and an outer face flange 805.

Rotary or pivotal movement of button 80 in a counterclockwise direction, when viewed in FIG. 61, pulls on cable 734 causing lock pin 728 to move out of engagement with plate 712. This permits the user to adjust the depth of the seat. Releasing the button causes the pin to return to its lock position under action of the spring 789 within housing 724. In addition, a torsional spring 792 is positioned between housing half 776 and button circular portion 762. The torsional spring resiliently biases the button to a centered or neutral position.

Seat Tilt Subassembly

Figure 70:
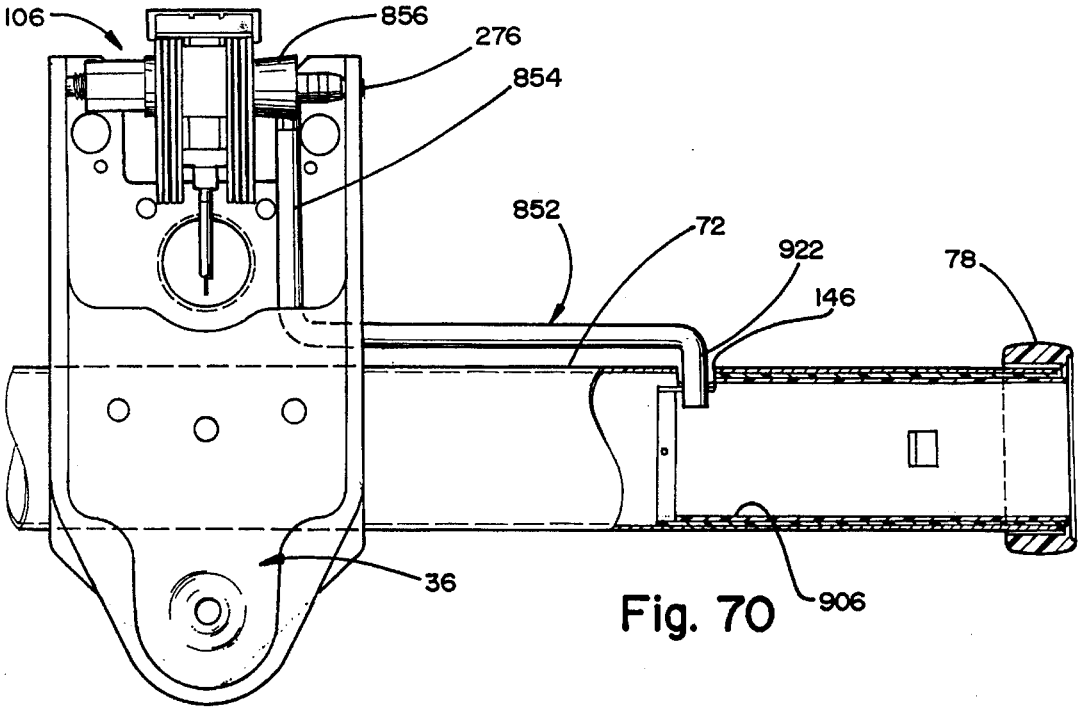
FIG. 70 is a fragmentary, top, plan view of a seat tilt adjustment actuator subassembly in accordance with the present invention.
Figure 71:
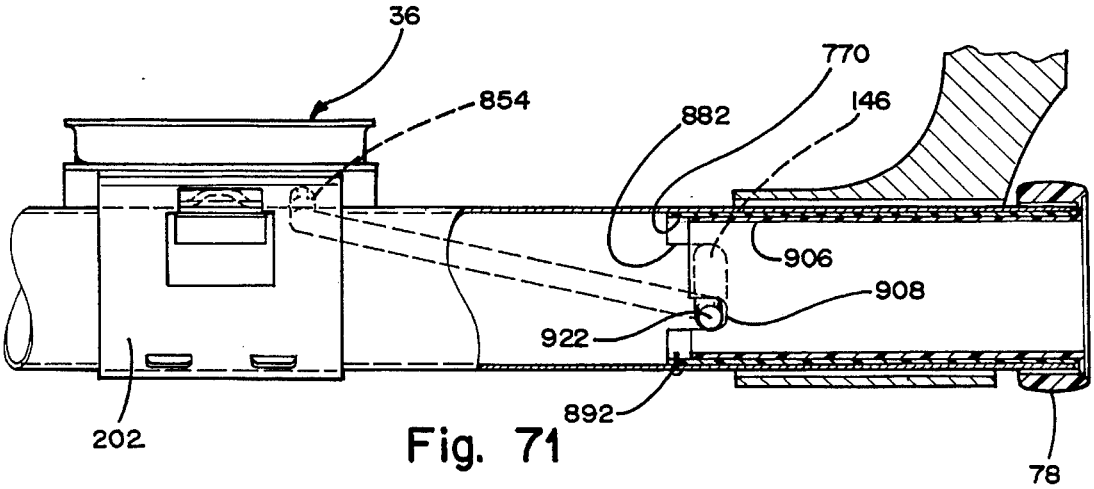
FIG. 71 is a front, elevational view of the subassembly of FIG. 70.
Figure 72:
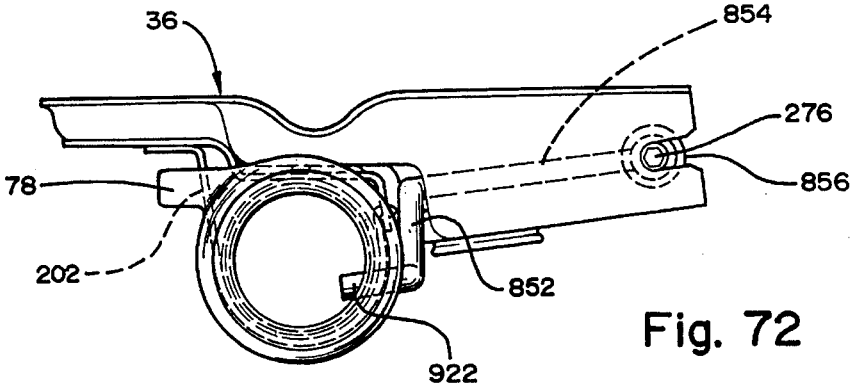
FIG. 72 is an end, elevational view of the subassembly of FIG. 70.

A seat tilt subassembly in accordance with the present invention is illustrated in FIGS. 70–72. The tilt subassembly includes a configured rod 852. Rod 852 includes a first portion 854 which engages a clamp member 856 mounted on axle 276 of the seat tilt adjustment portion 106. As explained in more detail in the aforementioned U.S. application Ser. No. 07/852,306, rotating portion 854 of the actuator rod 852 in a first direction cams clamp member 856 away from the interposed plates permitting tilting action of the rear portion of the seat with respect to the chair control. Bracket 284 attached to seat plate 712 (FIG. 60) may move with respect to the axle 276. A torsional spring around portion 854 resiliently biases actuator rod 852 to a position where the plates are locked together in a clutch-like fashion. Actuator rod 852 is rotated between the on and off positions by rotation of knob 78.

As seen in FIGS. 70 and 71, a sleeve 770 is inserted into the open end of tube 72. Sleeve 770 defines a slot 882 opening through an end 884 thereof. An opposite end 886 of sleeve 770 defines an annular flange 888 which abuts against the end of tube 72. Sleeve 770 further defines opposed slots 890. The sleeve is positioned into tube 72 so that slots 890 are aligned with slots 147 (FIGS. 7 and 8), as discussed in further detail below. Sleeve 770 further defines an aperture 892 which receives a securement screw.

Rotating knob or actuator 78 includes an outer circular portion 902 which may be formed with a lever 904. Portion 902 is formed integral with or joined to an elongated tube 906. Tube 906 has a slot 908 opening through an end 910 thereof. Tube 906 is also formed with angularly related apertures 912, 914. When assembling the actuator package, tubular portion 906 is slipped into sleeve 770, which has been positioned in tube 72. As seen in FIGS. 70 and 71, actuator rod 852 includes a second bent end 922 which extends through elongated slot 46 formed in housing 72. End 922 is captured within slot 908 defined by tubular portion 906 of the rotating knob 78. As should be apparent from FIGS. 70 and 71, rotation of actuator 78 and tube 906 moves end 922 of actuator rod 852 within slot 146. This, in turn, rotates rod portion 854 with respect to the clamp member 856 of the seat tilt subassembly.

Figure 69:
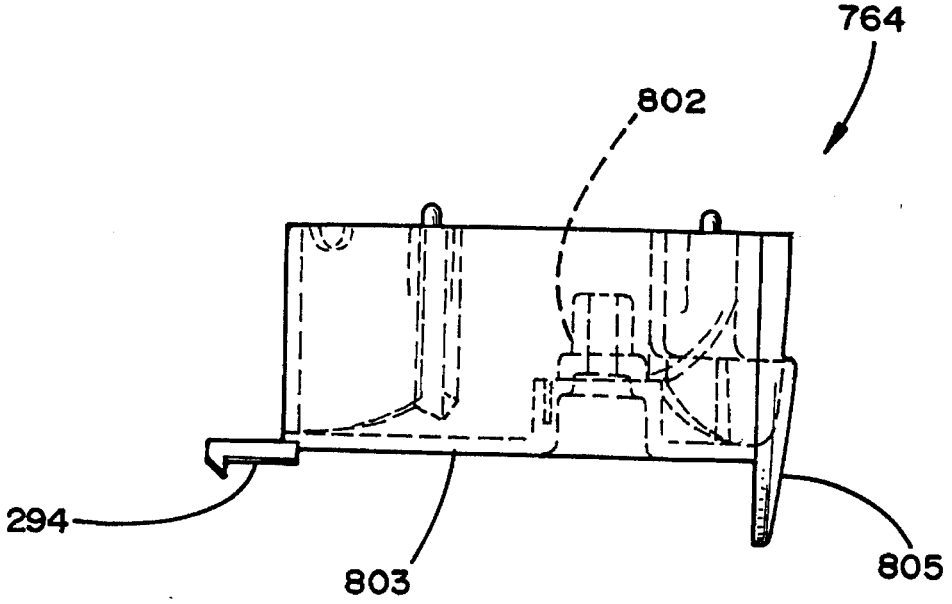
FIG. 69 is a side, elevational view of a button housing half incorporated in the subassembly of FIG. 61.
Figure 69A:
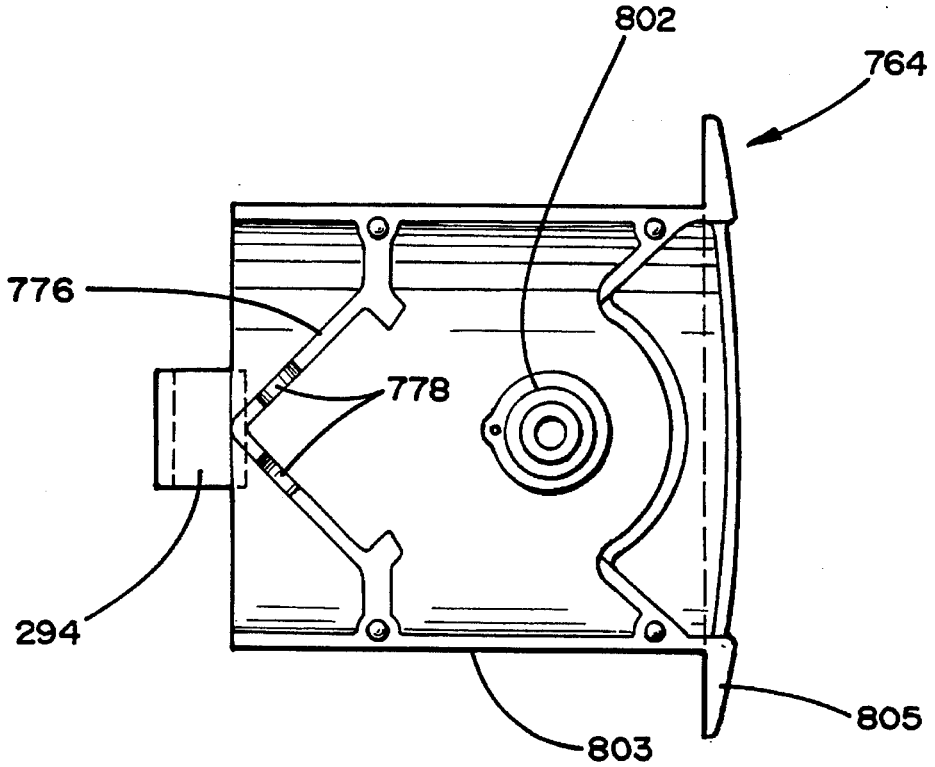
FIG. 69A is a plan view of the housing half of FIG. 69.

Sleeve 770 and actuator 78 are retained on the end of tube 72 by button housing halves 764, 766. Each half includes a detent 942 (FIG. 69). Detent 942 is configured to extend through elongated slots 912, 914 on tubular portion 906, through slots 890 formed on the sleeve 770 and into the slots formed in the outer housing. Since slots 912, 914 are elongated, tubular portion 906 may rotate with respect to the housing past the detents 942. The detents hold the housing and the end of the tube which, in turn, holds actuator 78 and tube 906 as well as sleeve 770 within the end of the tube.

Operation

In view of the above description, operation of the actuator subassembly and package in accordance with the present invention, as well as the adjustable chair, should be readily apparent. The package is assembled and attached to the undersurface of the chair. The cable subassemblies are attached to the respective adjustment mechanisms. The user can assume a seated position on the chair and look down to the right and view tension adjustment knob 82. The knob may be rotated to pivot lever 508, as described above, thereby adjusting the initial preload or tension on the back tilt control. The user can also push in button 84 shifting plunger 290 to adjust the back tilt position through the back stop subassembly. The user can look to the left and also adjust the seat features incorporated in the chair. Rotation of actuator 78 releases the clutch plates of the seat tilt subassembly permitting ready adjustment of the angular position of the seat. Rotation of button actuator 80 actuates the cable subassembly to shift lock pin 728 and permit depth adjustment of the seat and cushion subassembly 14 with respect to the back of the chair. Rotating actuators are provided for adjustment features which rotate or tilt with respect to the chair base and the user. The seat depth control moves in a front-to-back direction which is the same as the seat movement. Visual feedback and tactile feedback are provided to the user while adjusting the chair components. The features adjusted by or the action of the actuators are intuitive. The back control features are positioned at one side of the chair, and seat control features are positioned at the opposite side of the chair. The controls are at the same general location for a user to conveniently grasp. The controls are positioned in view of the user and not hidden. The package subassembly permits the actuator to be readily added to a chair without an adverse effect on aesthetic design. Changes need not be made in the aesthetic portions of the chair to accommodate actuator buttons and the like. All features need not be included in a single chair. The package approach provides different purchase options. The subassembly does, however, permit ready inclusion of adjustment features in the field.

In view of the above description, those of ordinary skill in the art may envision various modifications which would not depart from the inventive concepts disclosed herein. It is expressly intended that the above description should be considered as only a description of the preferred embodiment. The true spirit and scope of the present invention may be determined by reference to the appended claims.

The embodiments of the invention in which an exclusive property or privilege is claimed are defined as follows:

1. An adjustable chair subassembly, comprising:

a base;

a back support;

a control on the base connecting the back support to the base;

a seat positioned on said control;

an elongated, tubular actuator housing supported on said base, said actuator housing extending transversely of the seat and wherein said housing defines ends;

a first actuator mounted at one end of said housing; and a second actuator mounted at said one end of said housing, said first actuator being generally concentric with said second actuator, said actuator housing being dimensioned so that said first and second actuators are positioned to be conveniently viewed and used by a seated user of the chair subassembly, said second actuator including a push button slidably mounted in said one end of said actuator housing.

2. An adjustable chair subassembly, comprising:

a base;

a back support;

a control on the base connecting the back support to the base;

a seat positioned on said control;

an actuator housing supported on said base, said actuator housing defining ends;

a first actuator movably mounted at one end of said housing; and a second actuator mounted at said one end of said housing, said second actuator being adjacent to said first actuator, said actuator housing extending transversely of the seat with said one end at a point adjacent a lateral edge of said seat so that said first and second actuators are positioned to be conveniently viewed and used by a seated user of the chair subassembly, said first actuator being a rotating knob rotatably mounted on said one end of said actuator housing and generally concentric with said second actuator, said second actuator including a push button slidably mounted in said one end of said actuator housing.

3. An adjustable chair subassembly, comprising:

a base;

a back support;

a control on the base connecting the back support to the base;

a seat positioned on said control;

an actuator housing supported on said base, said actuator housing defining ends;

a first actuator movably mounted at one end of said housing;

a second actuator mounted at said one end of said housing, said second actuator being adjacent to said first actuator, said actuator housing extending transversely of the seat with said one end at a point adjacent a lateral edge of said seat so that said first and second actuators are positioned to be viewed by a seated user of the chair subassembly, said first actuator being a rotating knob rotatably mounted on said one end of said actuator housing and generally concentric with said second actuator, said second actuator being a push button slidably mounted in said one end of said actuator housing; and wherein said back support is pivoted to said control so that said back support may tilt from an upright position to a reclined position and said subassembly further comprises a torsional energy storage device for resiliently biasing said back support to the upright position.

4. An adjustable chair subassembly as defined by claim 3 further including tension adjustment means connected to said torsional energy storage device for adjusting the preload of said device and wherein said first actuator is operatively connected to said tension adjustment means.

5. An adjustable chair subassembly as defined by claim 4 wherein said tension adjustment means comprises:

a tension adjustment lever pivoted to and extending from said housing, said lever having first and second ends; and a link connecting said first end of said lever to said torsional energy storage device, said first actuator being operatively connected to said second end of said lever.

6. An adjustable chair subassembly as defined by claim 4 further comprising:

a first ramp mounted within said housing for horizontal movement, said ramp defining a threaded portion; and a lead screw engaging said threaded portion of said ramp, said first actuator being connected to said lead screw so that rotation of said first actuator moves said first ramp.

7. An adjustable chair subassembly as defined by claim 6 further comprising:

a second ramp mounted within said housing for vertical movement, said second ramp having an angled surface engaging said first ramp so that horizontal movement of said first ramp is translated into vertical movement of said second ramp.

8. An adjustable chair subassembly as defined by claim 7 further comprising:

a lever extending from and pivotally engaging said housing, said lever having a first end and a second end, said second end engaging said second ramp; and a link, said link connecting said second end of said lever with said torsional energy storage device.

9. An adjustable chair subassembly as defined by claim 8 wherein said first actuator further includes an elongated, noncircular tube extending from said knob to said lead screw.

10. An adjustable chair subassembly as defined by claim 3 further comprising back angle adjustment means for setting the angular position of the back support relative to said control, said second actuator being operatively connected to said back angle adjustment means.

11. An adjustable chair subassembly as defined by claim 10 further comprising:

a back cable assembly including a housing having an end fixed to said actuator housing and a cable; and a lever pivoted to said housing, said cable having an end connected to said lever and an end connected to said back angle adjustment means, said second actuator being connected to said lever.

12. An adjustable chair subassembly as defined by claim 11 further including an elongated push rod having an end engaging said second actuator and an end engaging said lever.

13. An adjustable chair subassembly as defined by claim 12 further including tension adjustment means connected to said torsional energy storage device for adjusting the preload force exerted on said back support by said device and wherein said first actuator is operatively connected to said tension adjustment means.

14. An adjustable chair subassembly as defined by claim 13 further comprising:

a tension adjustment lever pivoted to and extending from said housing, said lever having first and second ends; and a link connecting said first end of said lever to said torsional energy storage device.

15. An adjustable chair subassembly as defined by claim 14 further comprising:

a first ramp mounted within said housing for horizontal movement; and a lead screw engaging said first ramp, said first actuator being connected to said lead screw so that rotation of said first actuator moves said first ramp.

16. An adjustable chair subassembly as defined by claim 15 further comprising:

a second ramp mounted within said housing for vertical movement, said second ramp having an angled surface engaging said first ramp so that horizontal movement of said first ramp is translated into vertical movement of said second ramp, said second ramp engaging said second end of said lever.

17. An adjustable chair subassembly as defined by claim 16 wherein said first actuator further includes an elongated, noncircular tube extending from said knob to said lead screw, said lead screw and said first ramp each defining a bore aligned with said tube and wherein said push rod extends from said second actuator through said tube and said bore.

18. An adjustable chair subassembly as defined by claim 11 wherein said back angle adjustment means includes a slidably mounted plunger and said cable includes another end connected to said plunger.

19. An adjustable chair subassembly as defined by claim 18 wherein said back angle adjustment means further comprises:

a plunger and stop housing, said plunger being slidably mounted on said housing;

a stop movably mounted on said housing, said stop having a surface engaged by said back support to limit rearward tilting of said back support, said plunger being movable from an operative position engaging said stop to an inoperative position out of engagement with said stop by said cable; and a spring engaging said plunger End resiliently biasing said plunger to said operative position.

20. An adjustable chair subassembly as defined by claim 19 further comprising:

a catch operatively connected to said lever for holding the lever in a first position at which said plunger is in said inoperative position and for releasing said lever in response to movement of said second actuator for allowing said plunger to move to said operative position.

21. An adjustable chair subassembly as defined by claim 20 further including a stop spring on said plunger and stop housing for resiliently biasing said stop to a position extended from said housing.

22. An adjustable chair subassembly, comprising:

a base;

a back support;

a control on the base connecting the back support to the base;

a seat positioned on said control;

an actuator housing supported on said base, said actuator housing defining ends;

a first actuator movably mounted at one end of said housing;

a second actuator mounted at said one end of said housing, said second actuator being adjacent to said first actuator, said actuator housing extending transversely of the seat with said one end at a point adjacent a lateral edge of said seat so that said first and second actuators are positioned to be viewed by a seated user of the chair subassembly, said first actuator being a rotating knob rotatably mounted on said one end of said actuator housing and generally concentric with said second actuator, and said second actuator being a push button slidably mounted in said one end of said actuator housing; and a third actuator rotatably mounted on the other end of said actuator housing.

23. An adjustable chair subassembly as defined by claim 22 further comprising a fourth actuator pivoted to said housing at said other end, said third actuator surrounding said fourth actuator.

24. An adjustable chair subassembly as defined by claim 23 further comprising:

seat tilt adjustment means on said control for adjusting the tilt angle of the seat, said third actuator being operatively connected to said seat tilt adjustment means.

25. An adjustable chair subassembly as defined by claim 24 further comprising:

seat depth adjustment means on said control for allowing selective forward and rearward movement of said seat, said fourth actuator being operatively connected to said seat depth adjustment means.

26. An adjustable chair subassembly as defined by claim 23 further comprising:

back support tilt means on said control for pivotally mounting said back support with respect to said base, said tilt means including a torsional energy storage device for resiliently biasing said back support to an upright position, said first actuator being operatively connected to said torsional energy storage device.

27. An adjustable chair subassembly as defined by claim 26 further comprising:

an adjustable back stop assembly for adjustably positioning a stop to set the rearward tilt position of said back support, said second actuator being connected to said adjustable back stop assembly.

28. An adjustable chair subassembly as defined by claim 27 further comprising:

seat tilt adjustment means on said control for adjusting the tilt angle of the seat, said third actuator being operatively connected to said seat tilt adjustment means.

29. An adjustable chair subassembly as defined by claim 28 further comprising:

seat depth adjustment means on said control for allowing selective forward and rearward movement of said seat, said fourth actuator being operatively connected to said seat depth adjustment means.

30. A chair, comprising:

a back;

a base;

a control operatively and pivotably connecting the back to the base;

an actuator assembly including a tubular housing; and a pair of actuator mechanisms adapted to adjust two different functions associated with the pivoting of said back, the pair of actuator mechanisms including a pair of respective controls disposed adjacent each other at an end of said tubular housing of said actuator assembly, at least one of said pair of actuator mechanisms including a push button slidably mounted in said tubular housing of said actuator assembly.

31. A chair, comprising:

a back;

a base;

a seat supported on said base;

a control pivotably connecting the back to the base;

a tubular housing mounted adjacent said control below said seat, said housing having opposing ends and including a plurality of actuators located proximate one or another of said opposing ends removably attached to said housing, at least one of said actuators including a push button slidably mounted in said one end of said housing; and a pair of arms removably mounted on said tubular housing and contacting said housing inboard of said actuators.

* * * * *

UNITED STATES PATENT AND TRADEMARK OFFICE

CERTIFICATE OF CORRECTION

PATENT NO. : 5,577,807
DATED : November 26, 1996
INVENTOR : David N. Hodge et al.

It is certified that error appears in the above-identified patent and that said Letters Patent is hereby corrected as shown below:

Column 2, line 1;

".actuator" should be –actuator–.

Column 4, line 18;

"id" should be –is–.

Column 10, line 56;

"dr" should be –or–.

Column 17, Claim 19, line 21;

"End" should be –and–.

Signed and Sealed this

Twenty-ninth Day of April, 1997

*Attest:*

*Attesting Officer*

BRUCE LEHMAN

*Commissioner of Patents and Trademarks*